US006023047A

United States Patent [19]

Kondo et al.

[11] Patent Number: 6,023,047

[45] Date of Patent: Feb. 8, 2000

[54] IMAGE HEATING APPARATUS AND CONNECTOR WITH CONTACT MEMBER COVERING HEATER

[75] Inventors: Hiroshi Kondo; Kazuki Miyamoto, both of Yokohama, Japan

[73] Assignee: Canon Kabushiki Kaisha, Tokyo, Japan

[21] Appl. No.: 08/997,988

[22] Filed: Dec. 24, 1997

Related U.S. Application Data

[63] Continuation of application No. 08/401,787, Mar. 10, 1995, abandoned.

[30] Foreign Application Priority Data

Mar. 14, 1994 [JP] Japan ..... 6-070010

[51] Int. Cl.[7] ..... G03G 15/20

[52] U.S. Cl. ..... 219/216; 219/541; 399/329

[58] Field of Search ..... 219/216, 541; 399/329; 338/332

[56] References Cited

U.S. PATENT DOCUMENTS

| | | | |
|---|---|---|---|
| 2,288,235 | 6/1942 | Foley | 338/332 |
| 2,773,967 | 12/1956 | Cerney | 338/332 |
| 3,105,136 | 9/1963 | Ashenfarb . | |
| 4,531,047 | 7/1985 | Canfield et al. . | |
| 5,115,119 | 5/1992 | Adachi et al. . | |
| 5,148,226 | 9/1992 | Setoriyama et al. . | |
| 5,149,941 | 9/1992 | Hirabayashi et al. . | |
| 5,210,579 | 5/1993 | Setoriyama et al. . | |
| 5,262,834 | 11/1993 | Kusaka et al. . | |
| 5,288,973 | 2/1994 | Ota et al. . | |
| 5,376,773 | 12/1994 | Masuda et al. . | |
| 5,404,214 | 4/1995 | Yoshimoto et al. . | |
| 5,493,379 | 2/1996 | Kuroda et al. . | |

FOREIGN PATENT DOCUMENTS

| | | |
|---|---|---|
| 0 585 857 | 3/1994 | European Pat. Off. . |
| 43 18 721 | 12/1993 | Germany . |
| 60-047932 | 3/1985 | Japan . |
| 2-062571 | 3/1990 | Japan . |

*Primary Examiner*—Joseph Pelham

*Attorney, Agent, or Firm*—Fitzpatrick, Cella, Harper & Scinto

[57] ABSTRACT

An image heating apparatus includes a heater having an electrode; a film in sliding contact with the heater, wherein a toner image on a recording material is heated by heat from the heater through the film; a connector connected to the heater to supply electric energy to the heater; the connector comprising an electrically conductive contact member in contact with the electrode, the contact member encloses at least the heater.

12 Claims, 25 Drawing Sheets

IMAGE HEATING APPARATUS AND CONNECTOR WITH CONTACT MEMBER COVERING HEATER

This is a continuation of Application Ser. No. 08/401,787, filed Mar. 10, 1995, now abandoned.

FIELD OF THE INVENTION AND RELATED ART

The present invention relates to an image heating apparatus usable for a copying machine a laser beam printer or the like, and more particularly, to a connector for a heater.

Various connector have been proposed for electrical connections between parts.

Generally, a connector comprises a contact material having a spring property and having a desired configuration of electroconductive metal and a housing for supporting and electrically insulating the contact material. An inserting member to be electrically connected is inserted against the spring force of the contact member, by which the contact material of the connector and an electrode contact of the inserting member is press-contacted, thus establishing an electric connection. In other words, by the insertion of the inserting member, the contact member of the connector elastically deforms by a certain degree from a free state, and the load (reaction force) resulting from the elastic deformation is applied to the electrode of the inserting member, so that the inserting member and the electrode are press-contacted to establish the electric connection.

As performance criteria required for the contact member of the connector, there are electric performance such as electroconductivity (contact property, anti-wearing property and electromechanical corrosion), and mechanical performance such as spring property, spring constant, stress easing or the like.

As performance criteria required for the housing of the connector, there are electric performance such as insulative property, voltage durability property and mechanical performance such as dimensional stability (thermal deformation or softening), strength (crack) or the like.

As the inserting member connected to the connector, there are the one having the similar electrode at the position corresponding to the contact member, IC, circuit board, flexible substrate, ceramic substrate, glass substrate or the like. In some cases, the substrate or the member for supporting the substrate is simultaneously inserted.

Referring to FIGS. 22–24, an example of such a connecting structure and a connector will be described. The shown example is a connector for supplying electric energy to heating means for a film heating type heater for heat fusing an unfixed toner image carried on a recording material, usable with a copying machine, laser beam printer or another image forming apparatus (U.S. Patents Nos. 5,149,941, 5,262,834 or 5,148,226).

FIG. 22 is a plan view of a heater having connectors at the opposite ends thereof. FIG. 23 is a perspective view thereof, and FIG. 24 is an enlarged sectional view of the connector portions.

The electric energy supplying connectors 50, as shown in FIGS. 22 and 24, comprise contact members 51, 51 having spring property, of bent electroconductive metal plate (spring electrode, usually phosphor bronze), and a housing 52, 52 for supporting and insulating the contact member 51, 51. The contact member 51 and 51 are crimped with wire W, W.

The connector 50, 50 is mounted to the opposite ends of the heater 1 and the heater holder 7.

The contact member 51, 51 has a canti-lever structure and having a spring property. When the heater 1 and the heater holder 7 are inserted to the connector 50, 50, the following load is applied:

$$F=K\times\epsilon$$

where K is spring constant, "ϵ" is displacement.

Because of this force, the contact member 51, 51 contacts the electrode 4, 4, so that the electric contact is established between the contact member 51, 51 and the electrode contact 4, 4.

In order to assure the stable electric contact, the load F is desired to be maintained.

However, when the film in contact with the heater moves at high speed as a result of demand for the high speed operation, and the heater vibrates with the result that the contact between the electrode contact and the contact member is not stable.

When the load is applied for a long period of time, plastic deformation may occur due to creep, so that the displacement decreases. If this occurs, the applied load lowers. In the worst case, the load becomes zero, so that the contact is electrically opened. The creep remarkably appears when the ambient temperature is high. Therefore, the design of the connector 50, 50 takes into account the contact pressure reduction due to the creep. In order to do this, the spring constant of the contact member 51, 51 is increased, or the displacement of the contact member 51, 51 upon the insertion of the inserting member is increased. The method of increasing the spring contact of the contact member 51, 51 involves the problem that the variation of the thickness of the inserting member results in variation of the contact load, and therefore, it is not preferable from the standpoint of the stability of connection. The method in which the displacement of the contact member 51, 51 is increased, requires large force of insertion, and the electrode 4, 4 may be scraped upon the insertion of the inserting member, and therefore, this is not preferable.

SUMMARY OF THE INVENTION

Accordingly, it is a principal object of the present invention to provide an image heating apparatus in which the electric connection is stabilized between an electrode of the heater and a contact member of a connector.

It is another object of the present invention to provide a connector for stably supplying electric energy to the heater.

It is a further object of the present invention to provide an image heating apparatus in which a contact member of a connector encloses at least the heater.

It is a further object of the present invention to provide a connector having an electroconductive member in the form of a loop.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Referring to the accompanying drawings, the embodiments of the present invention will be described.

Figure 21:
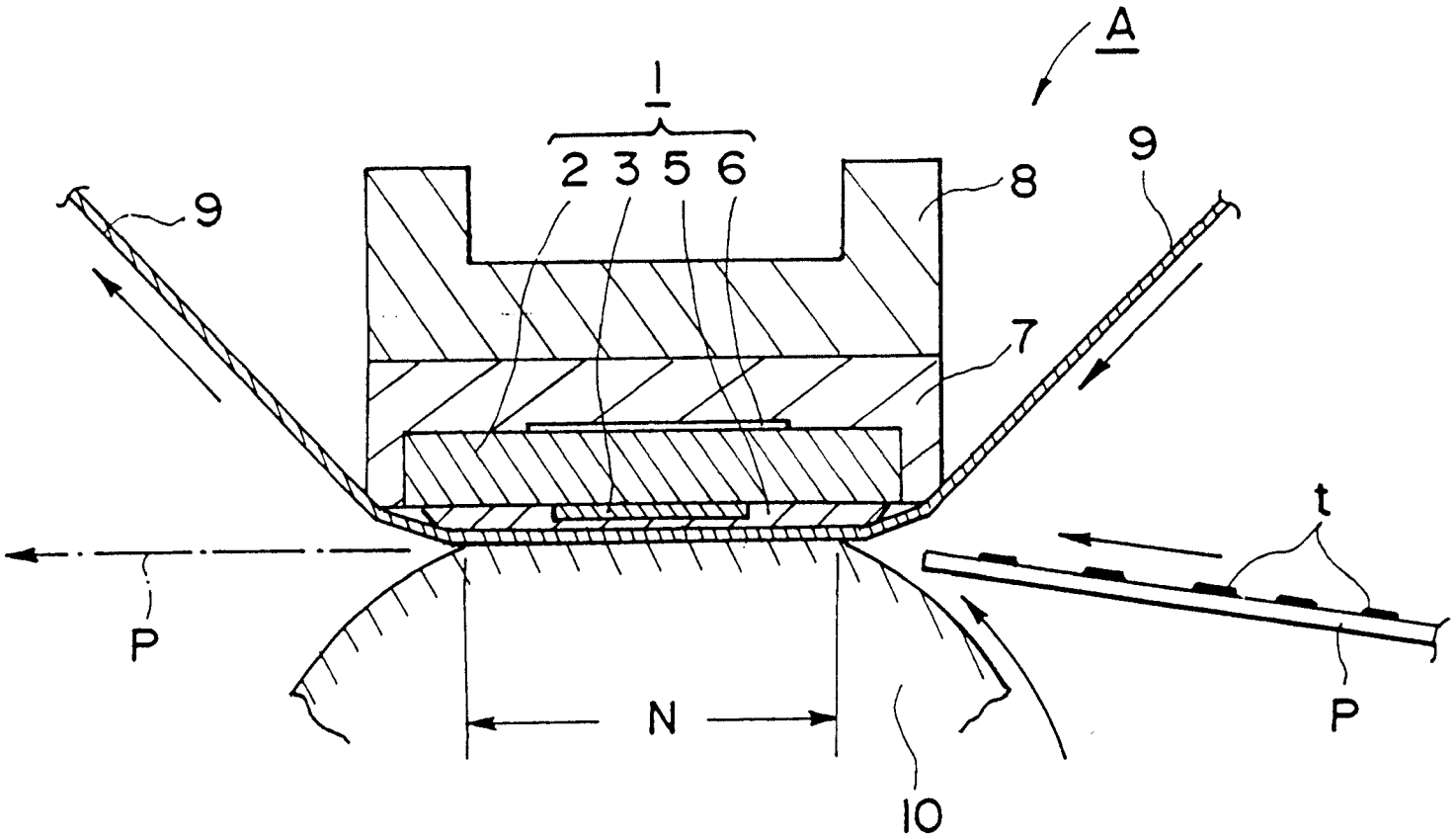
FIG. 21 is a partial sectional view of an image heating apparatus according to an embodiment of the present invention.
Figure 22:
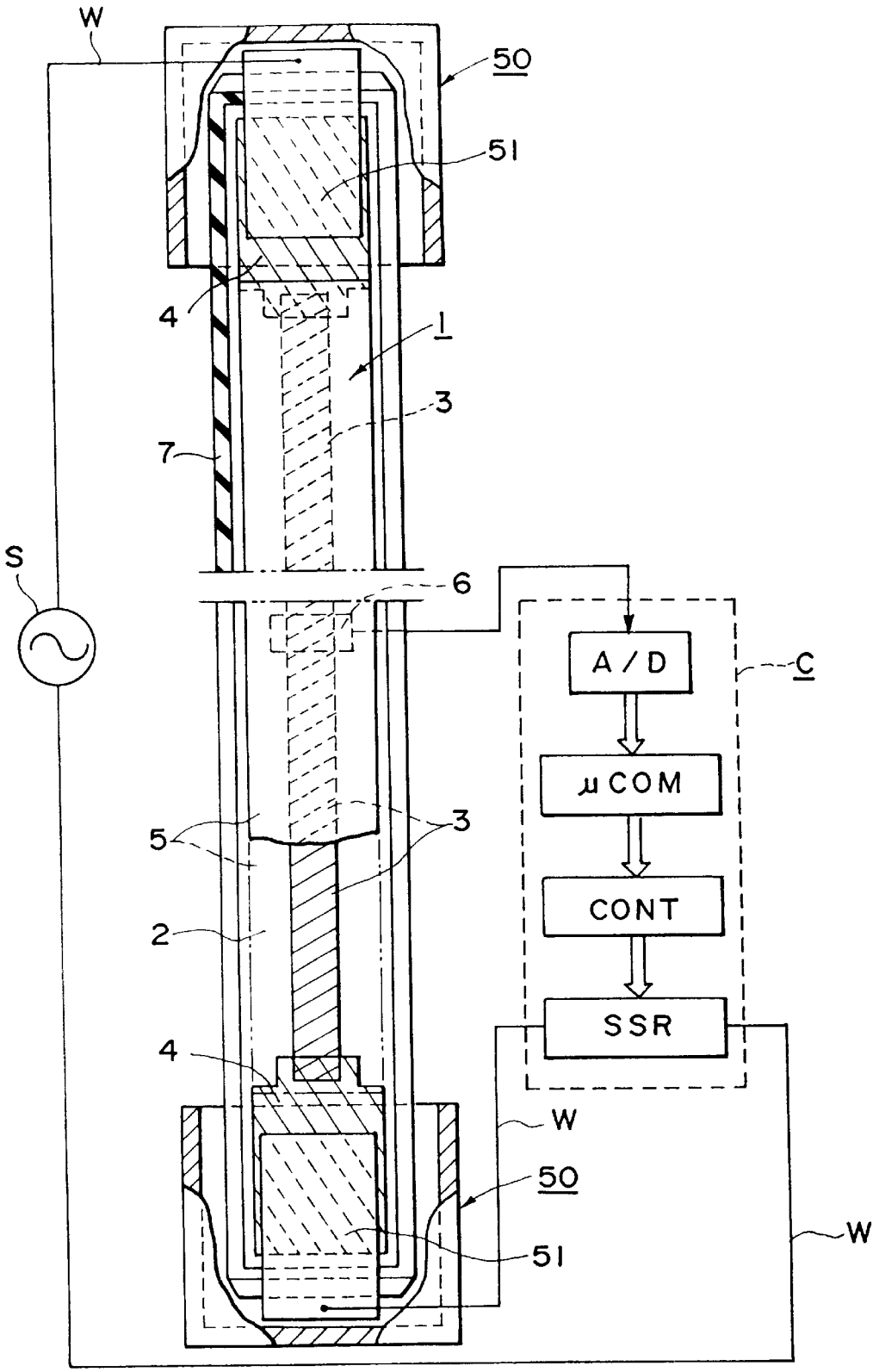
F I G. 22 PRIOR ART
FIG. 22 is a plan view of a heater connected with a conventional connector.
Figure 23:
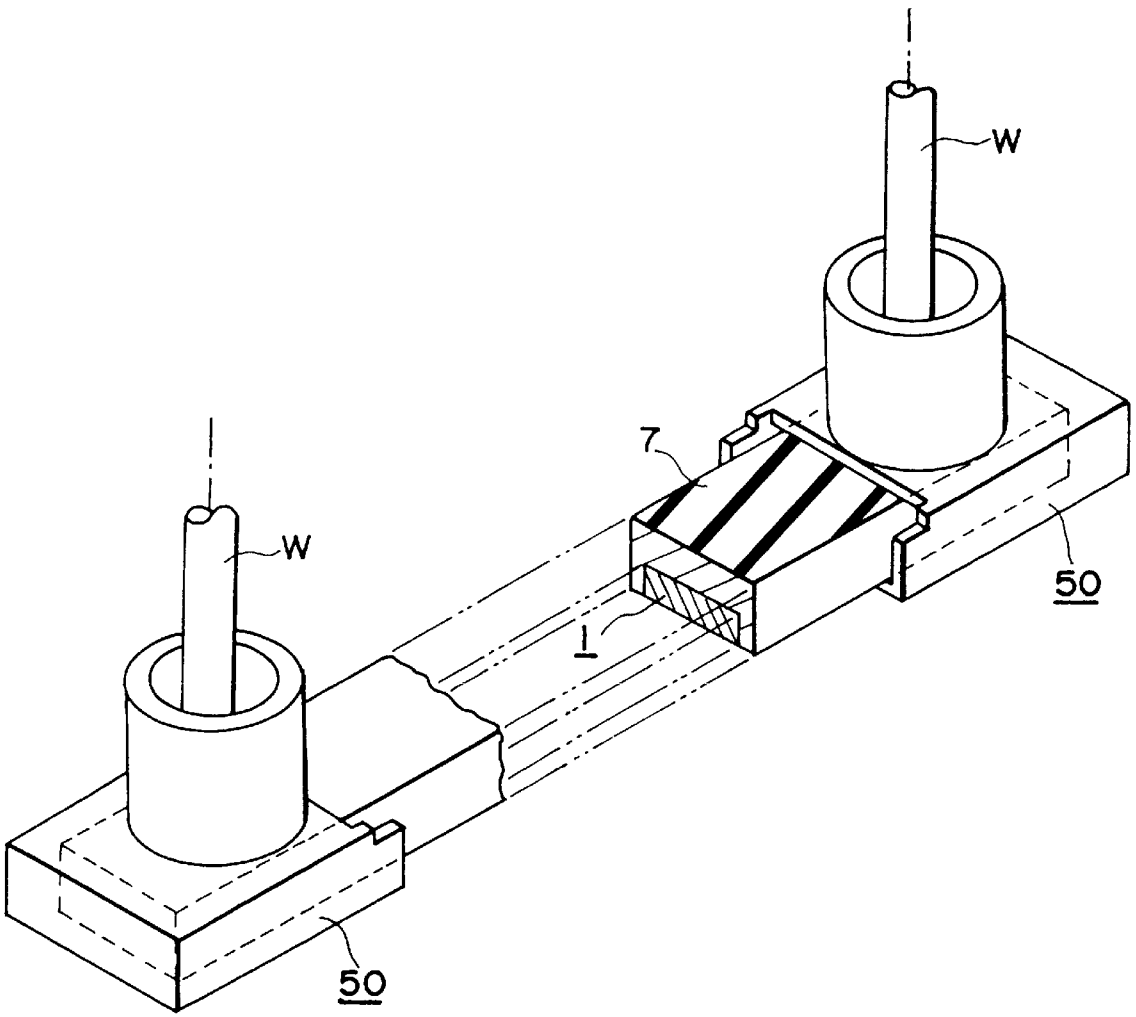
FIG. 23 PRIOR ART
FIG. 23 is a perspective view of the heater of FIG. 22.
Figure 24:
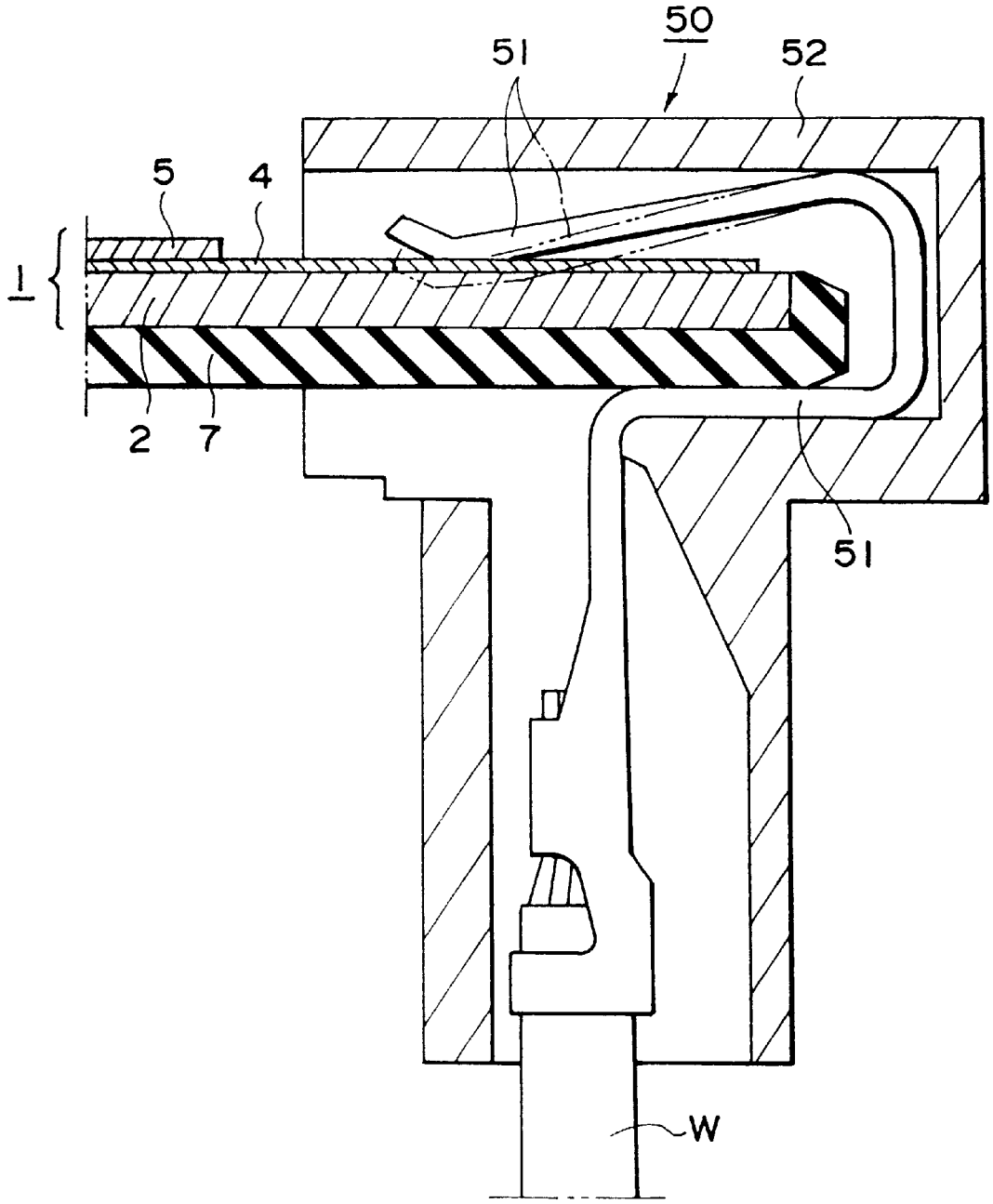
FIG. 24 PRIOR ART
FIG. 24 is an enlarged sectional view of the connector of FIG. 23.

Referring first to FIG. 21, there is shown a sectional view of an image heating apparatus. As shown in this Figure, heater 1 comprises (a) an elongated substrate 2 having an electrically insulative property, heat durability and low thermal capacity; (b) a heat generating element 3 in the form of a straight line extending along the length of the substrate substantially at the center of the space plate on one side (front side) of the base plate 2; (c) electrode contacts (contacts, electrodes) 4, 4 on the substrate in electric connection with the heat generating resistor 3 at the opposite ends thereof; (d) an electrical insulative overcoating layer 5 of metal or the like for protecting the surface of the heater at the side having the heat generating resistor on the substrate 2; and (e) a temperature detecting element 6 or the like such as thermister on the other side of the base plate 2 (rear side).

The substrate 2 is a ceramic plate such as $Al_2O_3$, AlN, SiC or the like having a length of 240 mm, a thickness of 1 mm and a width of 10 mm, for example.

The heat generating resistor 3 is in the form of a patterned layer provided by screen-printing Ag/Pd (silver palladium alloy), $RuO_2$, $Ta_2N$ or the like and sintered in the atmosphere. It has a thickness of 10 $\mu$m and a width of 1 mm, for example.

Electrode 4, 4 is in the form of a patterned layer formed by screen-printing Ag and sintered in the ambience. It usually has a thickness of 10 $\mu$m.

The coating layer 5 of the heater 1 is in slide contact with the film, and the side is exposed. The heater 1 is fixed on a heater support with a thermally insulative heater holder 7 therebetween.

A heat resistive film 9 has a thickness of approx. 40 $\mu$m, for example, and is of polyimide resin or the like. It is in the form of an endless belt or an elongated web. A pressing roller 10 functions as a pressure member for urging the film 9 to the heater 1.

The film 9 is rotated or traveled while in contact with the heater 1 surface with close-contact thereto in a direction indicated by an arrow at a predetermined speed, by an unshown driving member or by rotational force provided by the pressing roller 10. The heater 1 extends in a direction substantially perpendicular to the movement direction of the film 9.

To the opposite ends of the heater 1 and the heater holder 7, the electric energy supplying connectors are mounted, and the contact members of the connectors are press-contacted to the electrode contacts 4, 4 of the heat generating element 3 of the heater 1. An AC voltage is applied from a power source S to the electrode contacts through the connectors, so that the heat is produced by the heat generating element 3.

The temperature of the heater 1 is detected by a temperature sensor 6 provided on the backside of the base plate, and the output thereof is fed back to an electric energy supply controlling circuit C, and the electric energy supply to the heat generating element 3 from the power source S is controlled to maintain the temperature of the heater 1 at a predetermined level.

The temperature sensor 6 for the heater 1 is disposed at a position, on the backside of the base plate, corresponding to the position of the heat generating element 3 which is most responsive to the heat (the backside position right opposite from the heat generating resistor 3).

The heater 1 is disposed substantially at the center of the width of the fixing nip N of the heat generating element 3 in the cross-section of the apparatus for the control of the temperature of the fixing surface.

The temperature of the heater is increased to a predetermined level by the electric energy supply to the heat generating element 3 of the heater 1, and the film 9 is moved. By introducing the recording material P into the fixing nip N formed between the film 9 and the pressing roller 10 in the orientation in which the unfixed toner image on the recording material P is contactable to the film 9. By doing so, the recording material P passes through the fixing nip N with close contact to the film 9 surface. During the moving process, the thermal energy is applied to the recording material P through the film from the heater 1, so that the unfixed toner image t is heated and fused on the recording material P. The heating apparatus of this film heating type is advantageous in that low thermal capacity heating means exhibiting high temperature speed and a thin film heat resistive film, and therefore, the electric energy can be saved, and the waiting period can be reduced (quick start). In addition, the temperature rise in the main assembly of the image forming apparatus can be avoided.

The description will be made as to the connector and the connecting structure for the heater for the electric power supply.

Figure 1:
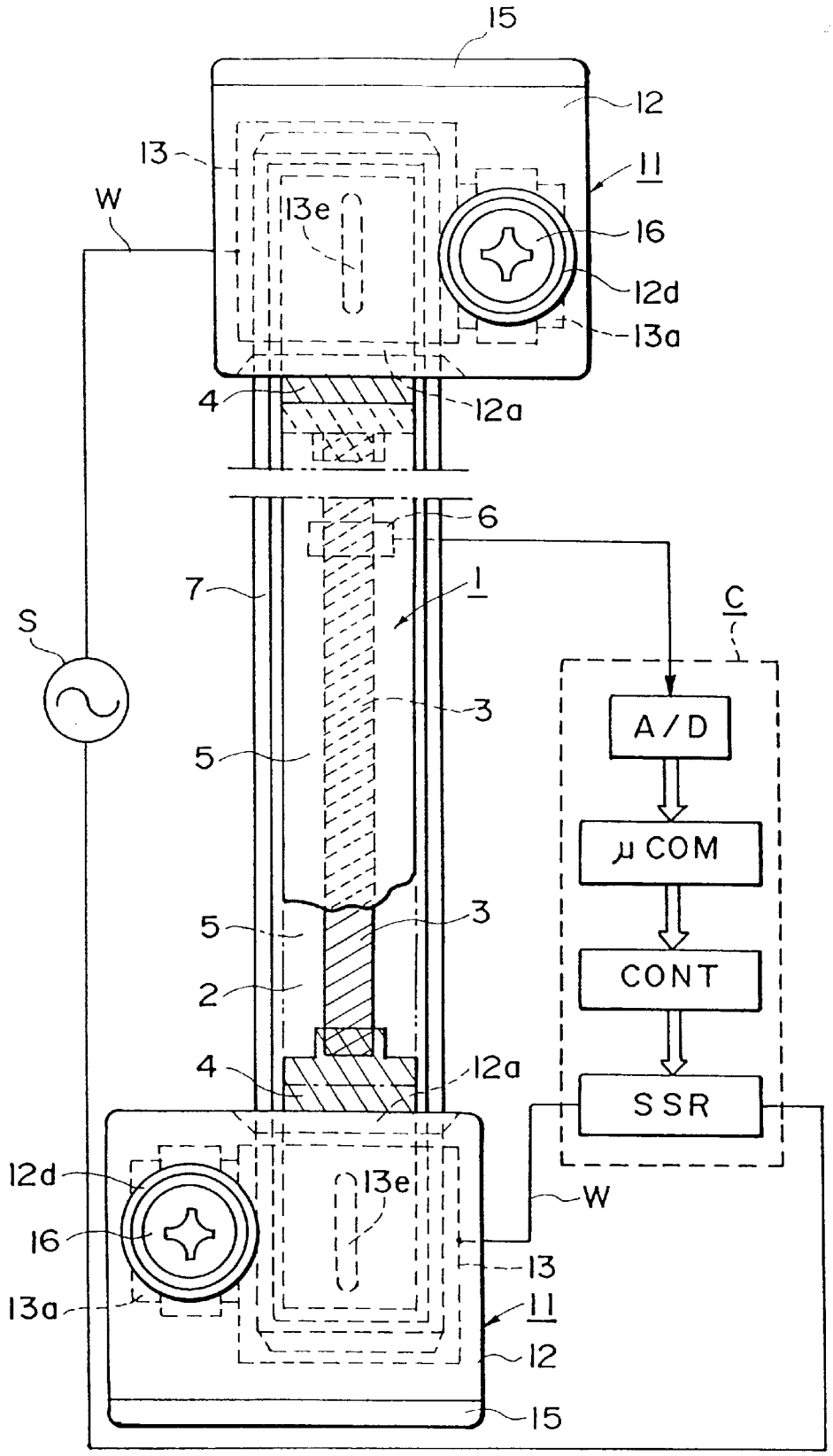
FIG. 1 is a top plan view of a heater to which a connector according to an embodiment of the present invention is connected.
Figure 2:
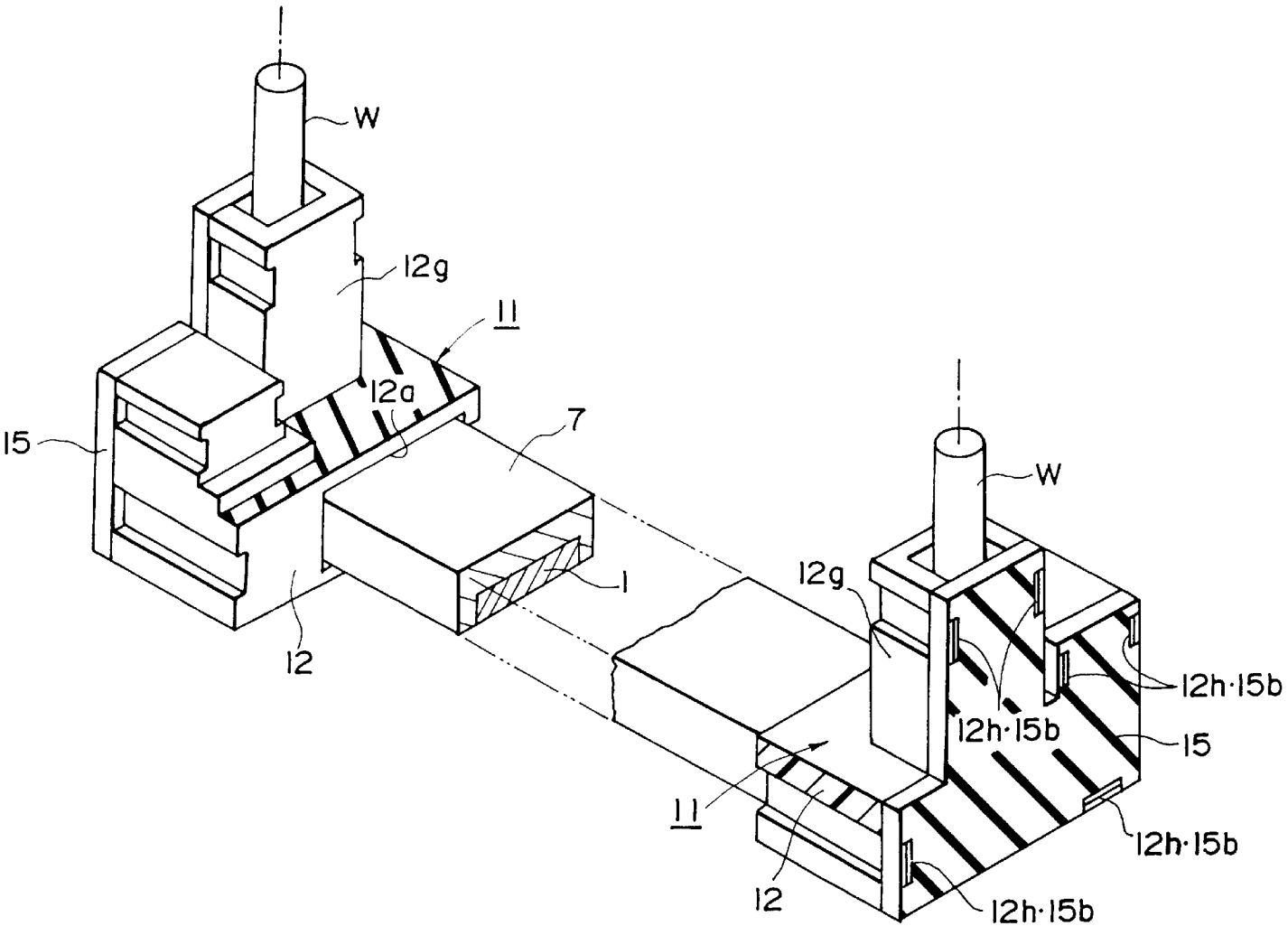
FIG. 2 is a perspective view of a heater to which the connector is connected.

FIG. 1 shows an electric energy supplying connector 11 provided in the heater 1, and FIG. 1 is a top plan view and a circuit diagram, and FIG. 2 is a perspective view of the opposite ends of the heater.

Figure 3:
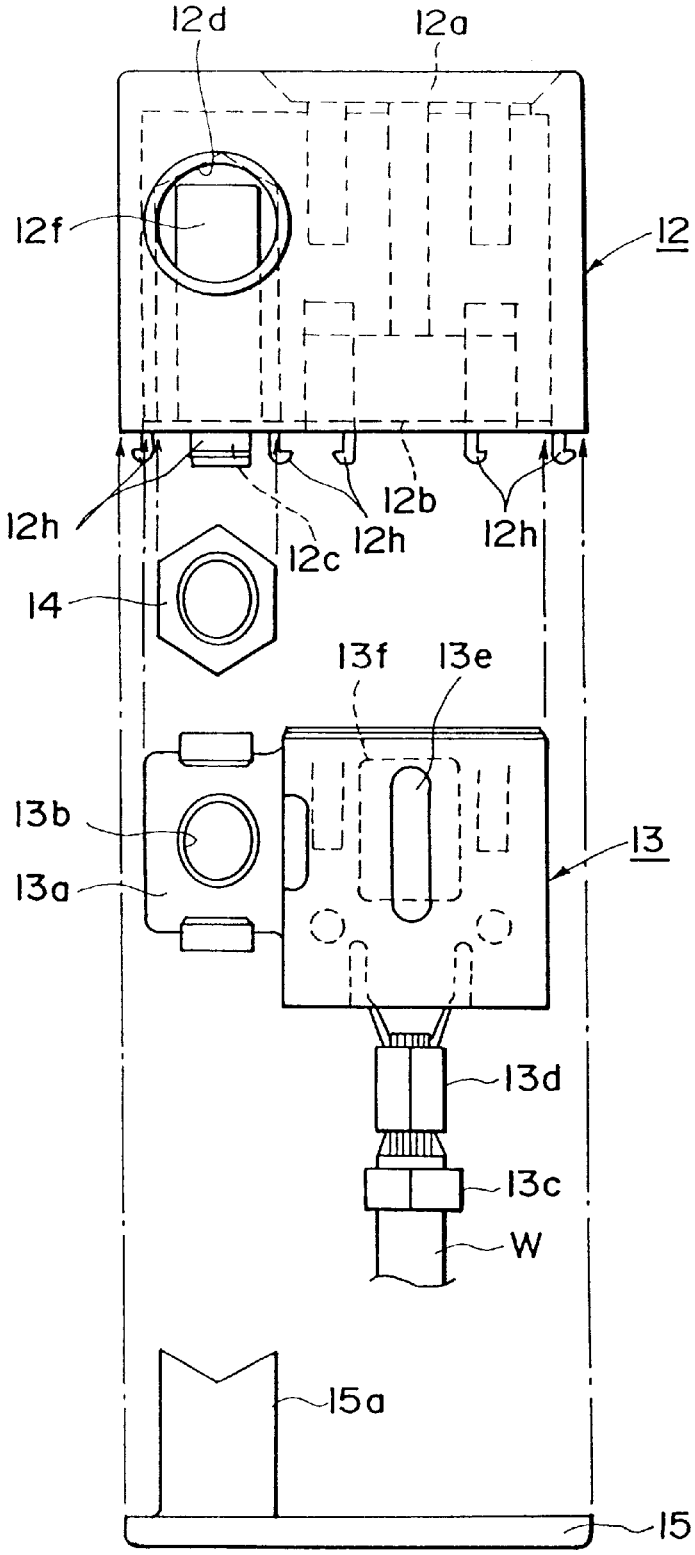
FIG. 3 is an exploded plan view of the connector.

The connectors 11 and 11 have the same structure and are provided at the opposite ends of the heater. As shown in the exploded plan view of FIG. 3, each of them comprises a housing body (connector housing) 12, a contact member 13 to be inserted into the housing body 12, a hexagonal nut 14 as one of clamping member for the contact member 13 and inserted into the housing body 12, a cover housing 15 for sealing for an opening for the contact member and the nut at the backside of the housing body 12, a screw 16 as another clamping means for the contact member 13 to be threaded into the nut 14 (FIGS. 1 and 7), namely, 5 parts.

Each part will be described in detail.

(1) Housing body 11

Figure 4:
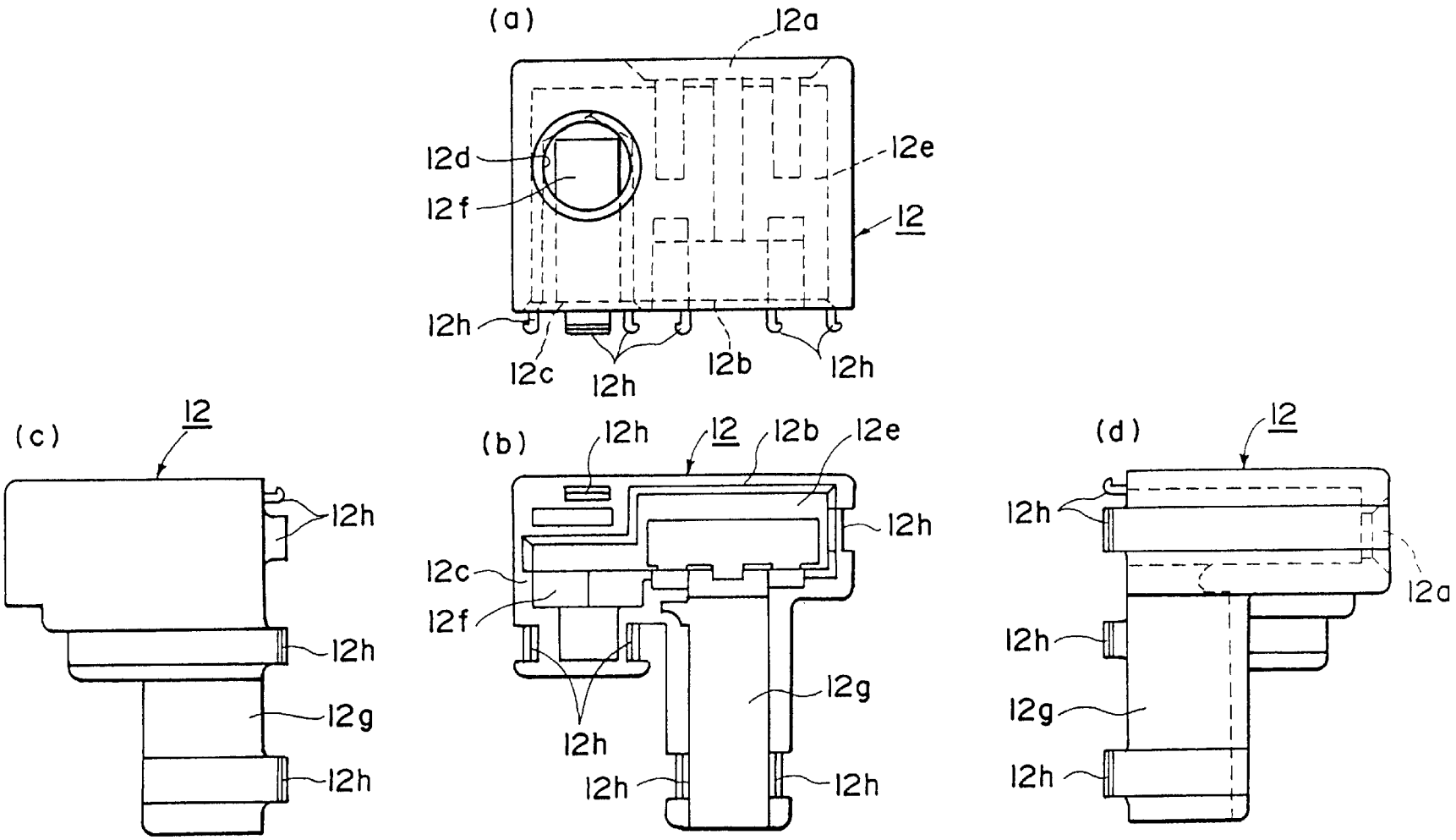
FIG. 4 illustrates a housing of the connector.
Figure 4A:
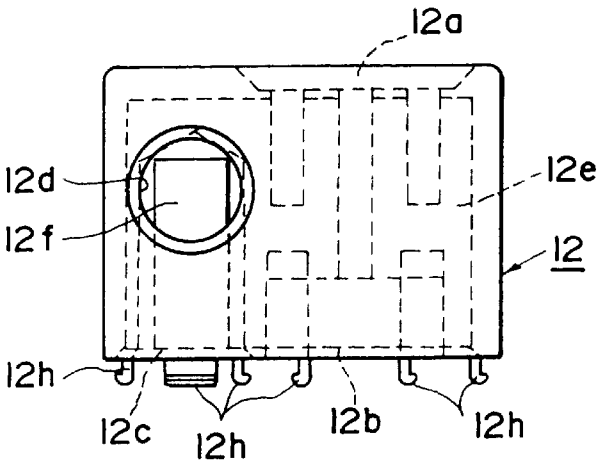
Figure 4B:
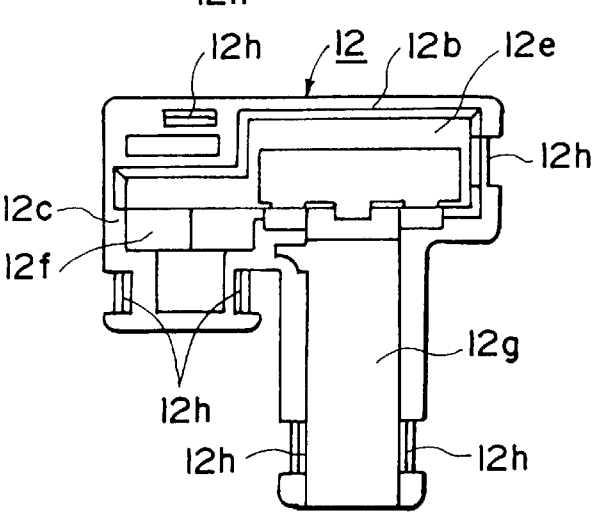
Figure 4D:
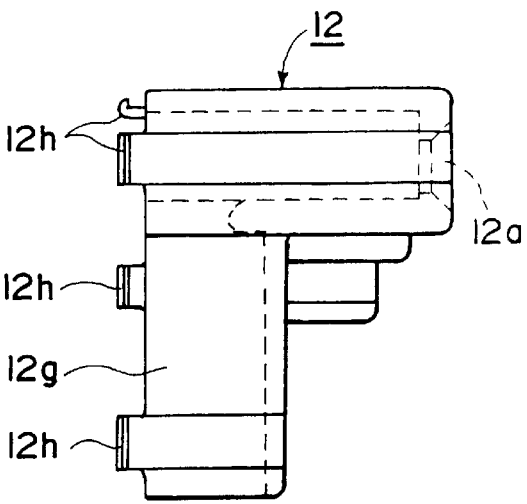
Figure 4C:
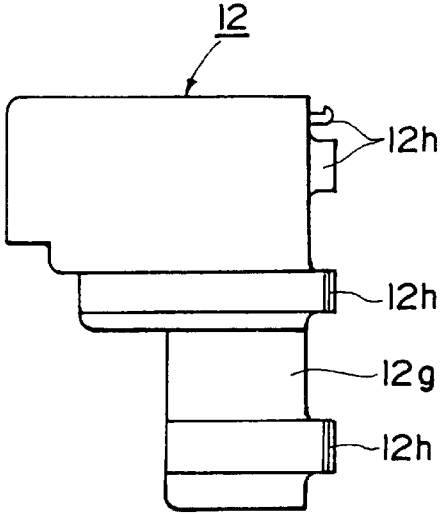

Referring to FIG. 4, (a) is a plan view of a housing body, (b) is a backside view, (c), (d) are lest side view and a right side view.

The housing body 11 is of electrically insulative material, nylon, PBT, PET or another resin material.

The front side is provided with an opening 12*a* for receiving an end of a heater 1 and a heater holder 7.

The upper side is provided with a screw hole 12*d* for receiving a screw 16. In the housing body 12, there are provided a contact accommodating portion 12*e*, nut accommodating portion (nut guide) 12*f*. The nut accommodating portion 12*f* supports a pair of hexagonal nut 14 and a bottom part thereof.

The backside of the housing body 11 is provided with a wire case 12*g* extending in a direction perpendicular to the inserting direction of the contact member 13.

(2) Contact member 13

Referring to FIG. 5, (a) is a top plan view of the contact member 13, (b) is a front view, and (c) is a left side view.

The contact member 13 is formed of a metal plate having a spring property and electroconductivity. The contact member has such a structure as to enclose at least the following portion of the inserted portion of the heater 1 and the heater holder 7, namely, the electrode contact surface, and the surface connecting therefrom, and a backside in contact with the side surface. That is, the peripheral surface of the inserted portion of the inserting members 1 and 7 are continuously enclosed. One side is open. If the heater itself has substantial strength, the heater holder is not inevitable. In this case, the contact member encloses only the heater.

From the open side, tabs 13*a* and 13*a* are extended outwardly, and the tabs are provided with openings 13*b* and 13*b*.

The contact portion for the electrode contact 4 of the heater 1 is in the form of a V-projection to provide the spring property for the connection with the inserting members 1 and 7. The downward apex 13*e* of the contact member 13 functions as an electric connection part between the contact member 12 and the heater 1.

At the backside of the contact member 13, there is provided an insulation barrel portion 13*c* and a wire barrel portion 13*d* for connection with electric energy supply wire W.

(3) Cover housing 15

Referring to FIG. 6, (a) shows an outer appearance of a cover housing 15, (b) is a right side view, (c) is an inside view, and (d) is a plan view.

The cover housing 15 is made of insulative material as in the housing body 12, for example nylon, PBT, PET or another resin material. It is made plate like member having substantially the same configuration as the outer configuration of the backside of the housing body 12, the inside thereof is provided with a projection 15*a* for supporting a nut to be fitted in a nut accommodating portion 12*f* through a nut inserting opening 12*c* of the housing body 12.

The description will be made as to the assembling of the connector 11. The connector 11 is assembled in the following manner. The nut 14 is inserted through an opening 12*c* in the back side of the housing body 12 into the nut accommodating portion 12*f* in the housing body 12 to be sufficiently received by the nut accommodating portion. By this, the threaded opening of the nut 14 is correctly positioned relative to the screw opening 12*d* of the housing body 12.

Then, the contact member 13 is inserted through the contact member opening 12*a*, until it abuts. By the sufficient insertion, the portion of the tab 13*a* and 13*b* of the contact member 12 is positioned above the nut 14, so that the openings 13*b* and 13*b* of the tabs 13*a* and 13*b* correspond to the threaded opening of the nut 14. The contact member 13 is provided with a lanced and erected portion, which when the contact member is inserted through the opening 12*b* into the contact member accommodating portion 12*e* through a predetermined degree, interferes with the housing body 12 to prevent further insertion and prevents removal of the contact by interference with the housing body 12.

The wire W is connected to the insulation barrel portion 13*c* and the wire barrel portion 13*d* of the contact member 12, and the wire connecting portion is bent relative to the contact member 13 by 90 degrees, and the base portion of the wire is accommodated in a wire case 12*g* of the housing body 12. The backside of the housing body having the openings 12*b* and 12*c* is closed by the cover housing 15. The covering of the housing body by the cover housing 15 is as follows. The housing body 12 is provided with claws 12*h*, and the cover housing 15 is provided with engaging holes 15*b* corresponding to the claws 12*h*, and they are engaged. The order of insertions of the nut 16 and the contact member 13 into the housing body 12 may be the opposite. The contact member 13 may be inserted into the housing body 12 after the wire W is connected to the contact member 13. The mounting of the cover housing 15 to the housing body 12 may be accomplished by screws, bonding materials or another mounting means.

Figure 7:
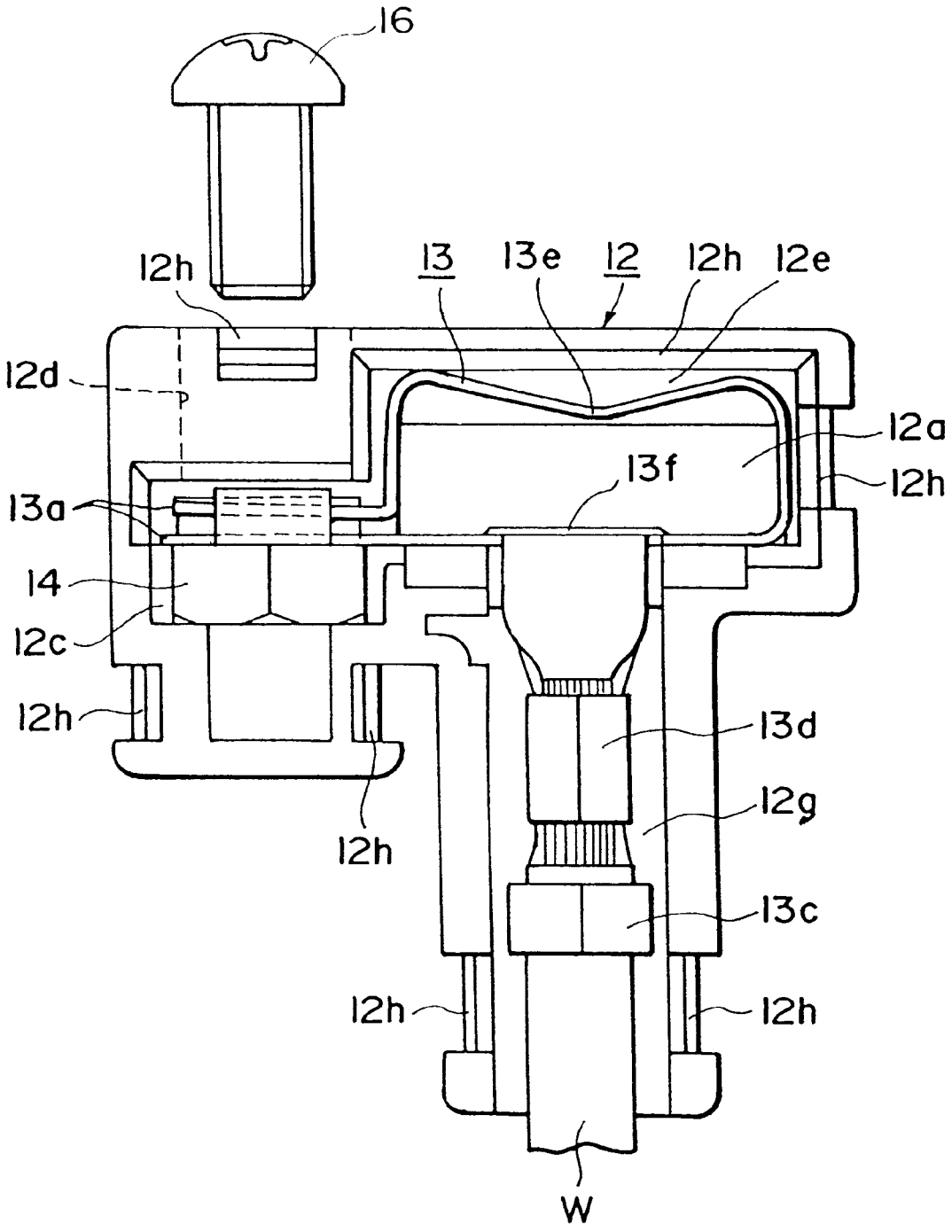
FIG. 7 illustrates a connector before insertion of the heater.
Figure 8:
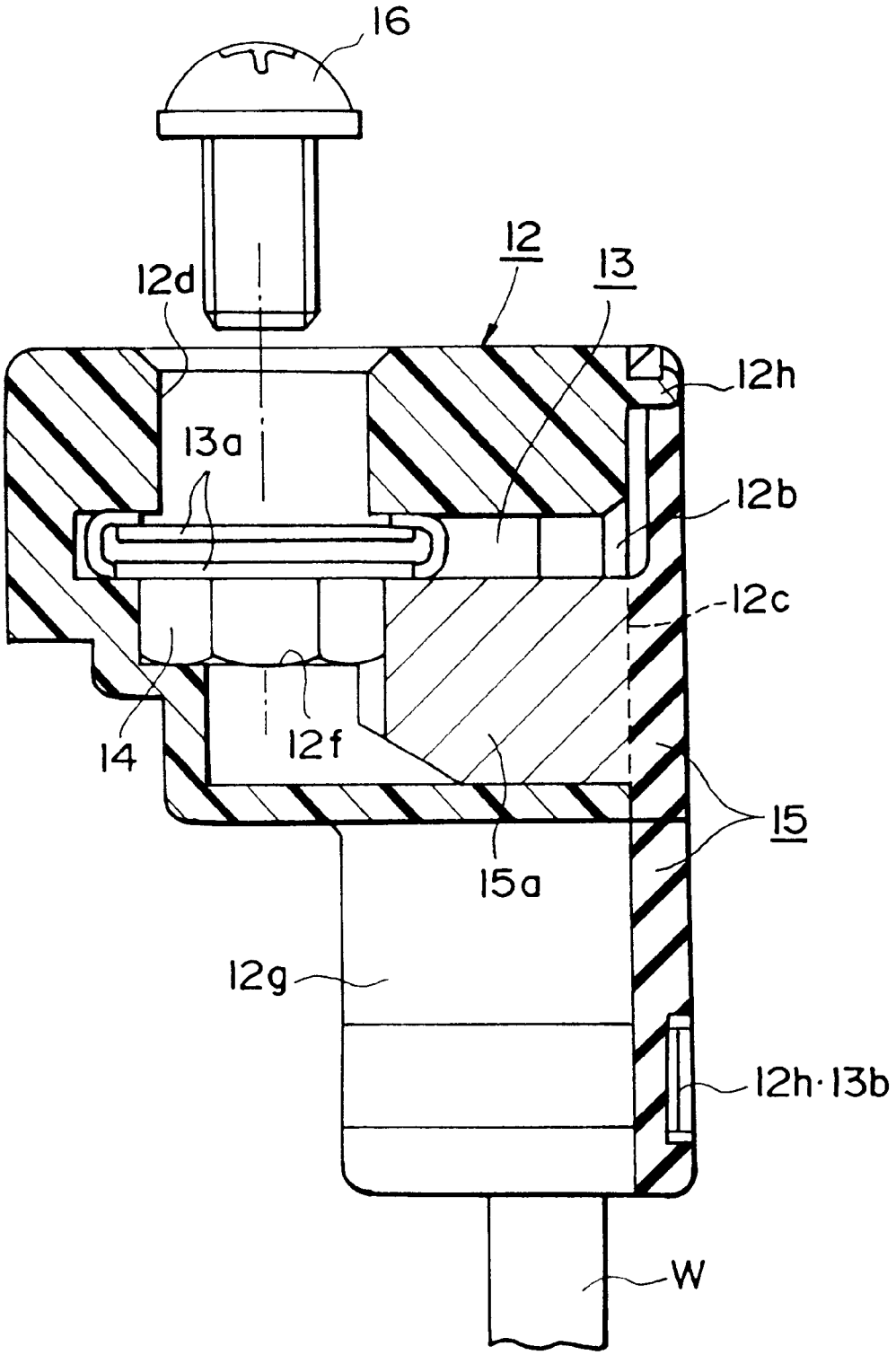
FIG. 8 is a side view of the connector shown in FIG. 7.
Figure 9:
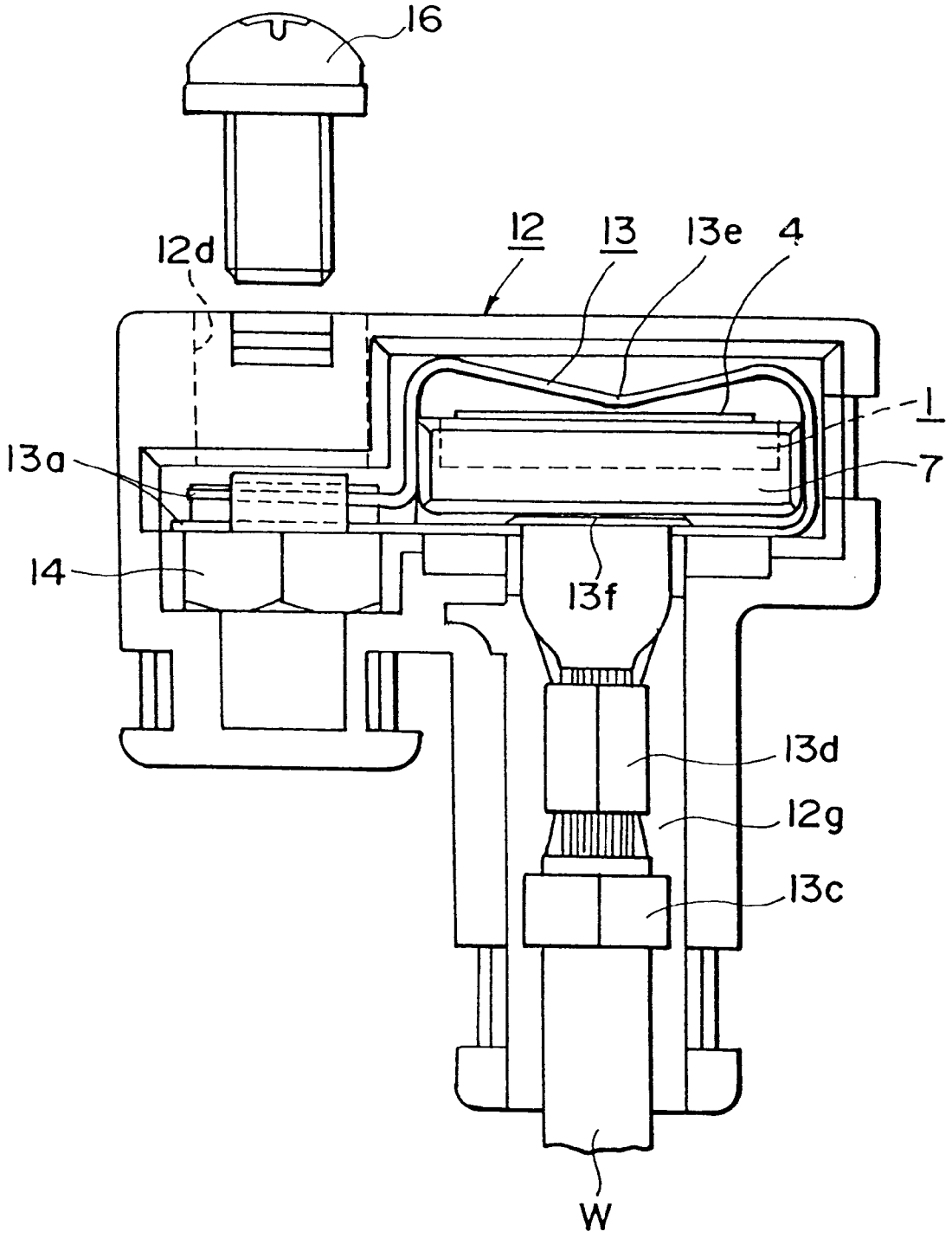
FIG. 9 illustrates a connector before the contact member is crimped and after the heater is inserted.

The description will be made as to the connection between the connector 11 and the inserting members 1 and 7. Before the screw 16 is secured to the nut 14 through the openings 13*b* and 13*b*, the contact member 13 is exposed at one side as shown in FIGS. 7 and 8. In this state, an end of the heater 1 and an end of the heater holder 7 (inserting member) are inserted through an opening 12*a* in the front side of the connector 11. FIG. 9 shows this state.

Upon the insertion, since the side is free, the upper part of the contact member 13 can move and escape upwardly, and therefore, the inserting force is not strong, and the damage on the surface of the contact 4 is less.

Figure 10:
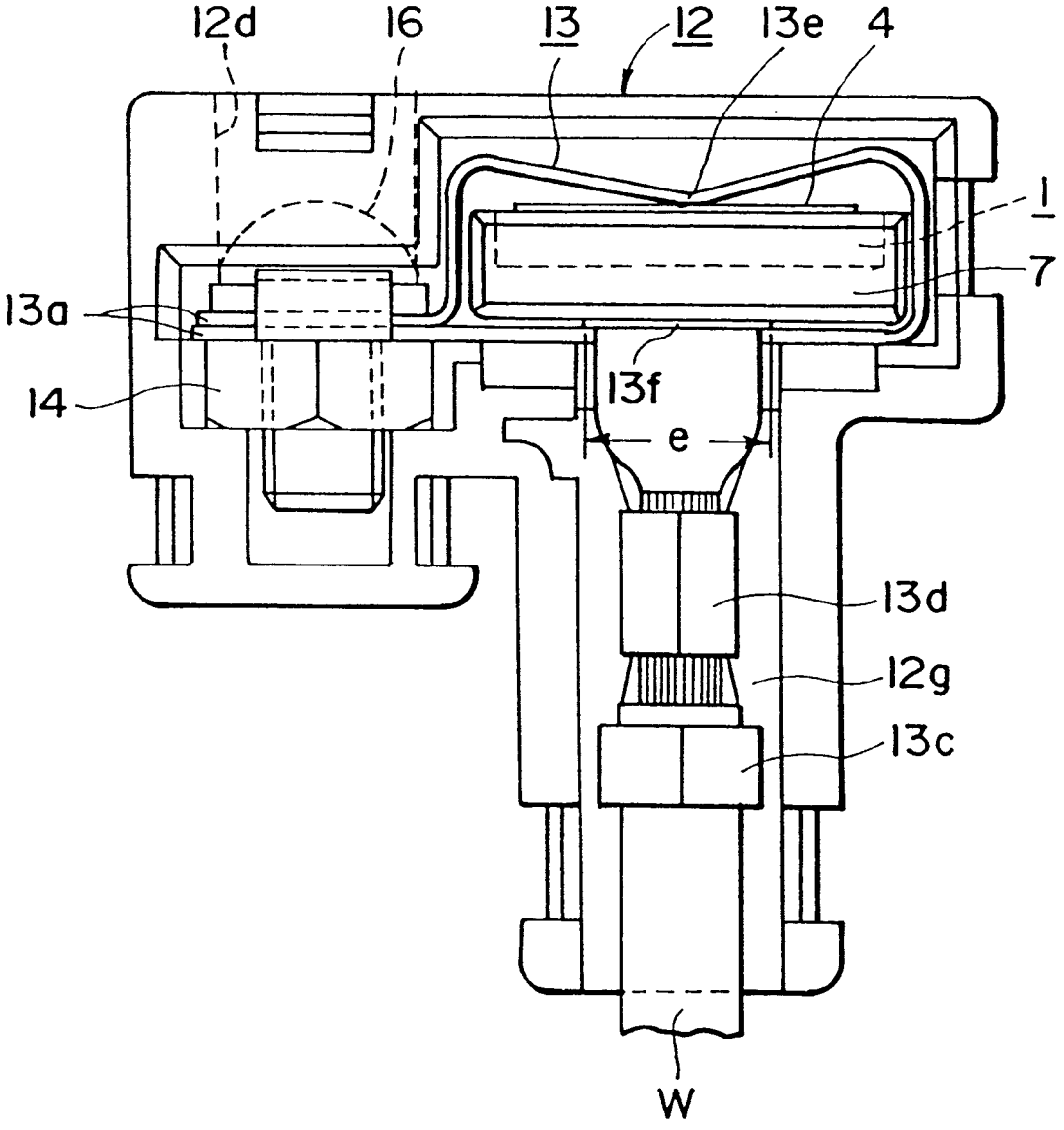
FIG. 10 illustrates the connector after the contact member is crimped and after the heater is inserted.
Figure 11:
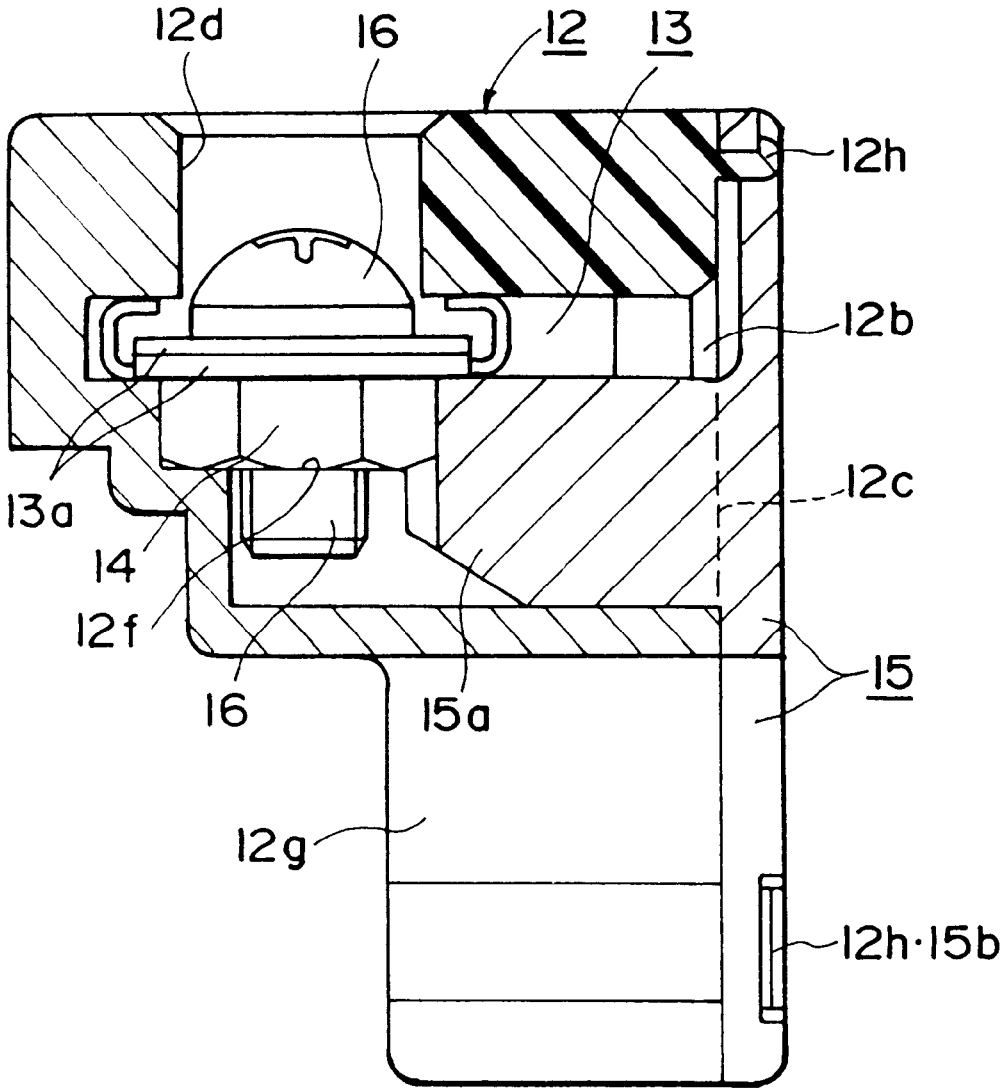
FIG. 11 is a left side view of the connector of FIG. 10.
Figure 12:
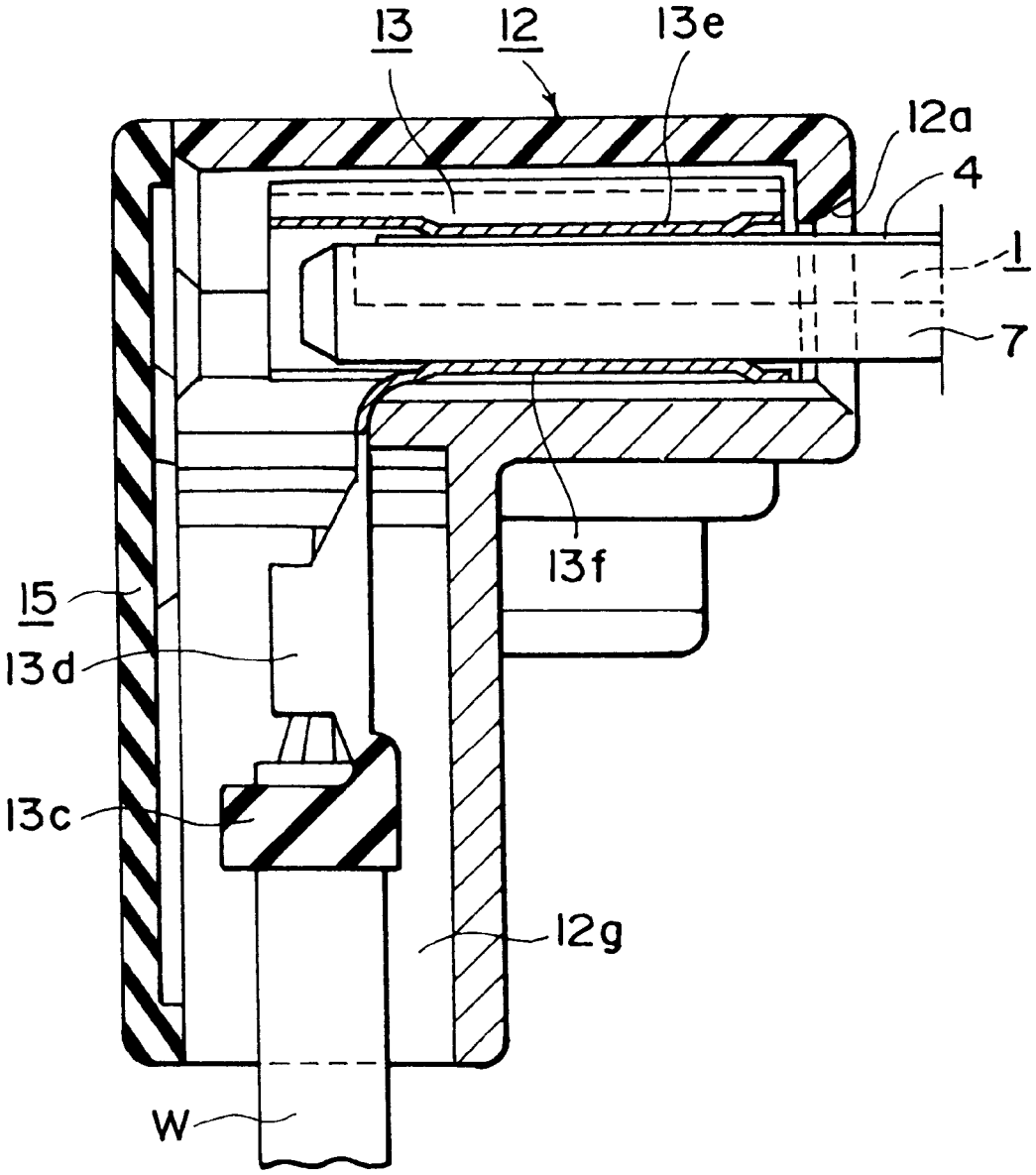
FIG. 12 is a right side view of the heater of FIG. 10.

Subsequently, the screw 16 is secured relative to the nut 14, so that the tabs 13*a* and 13*b* which are open from each other, are closed against the spring property of the contact member 13, as shown in FIGS. 10 and 11. By this, a large displacement can be imparted to downward apex 13*e* (V-shaped) of the contact member which functions as electric connection between the contact 12 and the electrode contact 14 of the heater 1. FIG. 12 is a schematic longitudinal sectional view of the contact member accommodating portion when the electric connection is established.

The contact member 12 of the connector 11 has a V cross-section at the portion opposed to the electrode terminal or contact 4 of the heater 1 surface at the end of the heater 1, heater holder 7 (inserting member), and in addition it encloses the inserting member 1, 7 by its channel-like cross-section. When the inserting member 1, 7 is inserted, the screw 16 is not threaded into the nut 14, and in addition, the screw 16 is in a loose state, by which the open state of the channel like shape is provided (FIGS. 7 and 8). After the insertion, the screw 16 is rotated and secured so that the open portion 13*a*, 13*a* is closed (FIGS. 10 and 11), by which the inserting member 1, 7 is enclosed by the cylindrical shape.

At this time, the electrode contact 4 receives the load depending on the displacement of the downward apex 13*e* having a V cross-section, which is the electric connection point between the contact member 12 and the electrode contact 4 of the heater 1.

In this manner, the contact member encloses the heater, and therefore, the deviation between the contact member and the heater can be suppressed, by which the contact between the electrode contact of the heater and the contact member can be assured and stabilized.

By this structure, the small inserting force is enough (FIG. 9), and there is no need of grinding the electrode contact 4 upon the insertion, and the surface of the electrode contact 4 is not damaged. By clamping using the screw (FIG. 10), the large displacement can be provided so that the large load can be provided. Therefore, high connection stability is accomplished.

The description will be made as to the holding and positioning of the nut 14. In order to assure the displacement of the contact member 13 during the securing of the nut 14, it is preferable that the nut is contacted to the contact member 13. If the nut 14 and the contact member 13 are not closely contacted and integrated with each other, the securing of the screw 16 is instabilized with the reliability of loosening of the screw 16, decrease of the displacement of the contact member 13 and therefore decreasing of the load.

If the housing body 12 and the nut 14 are made integral as in insertion molding, the close contact is not established because of the error within the tolerance in the height of the nut surface made integral with the tab or flange 13*a*, 13*a* of the contact member. Therefore, it is not so preferable that the housing body 12 and the nut 14 are completely integrated.

Figure 14:
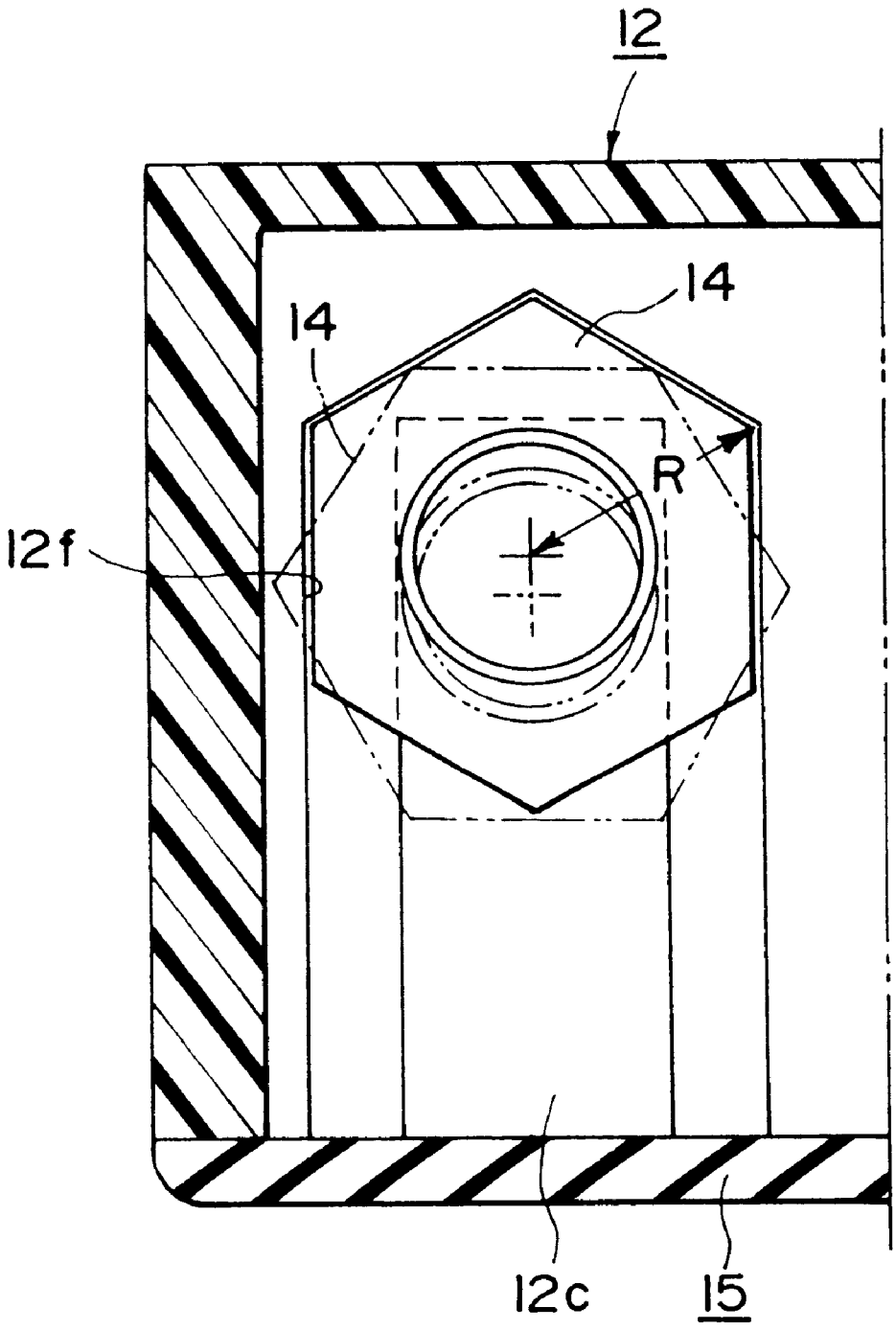
FIG. 14 illustrates rotational deviation of the hexagonal nut.

Since the nut is isolated, the housing body 12 is required to hold the nut side surface to prevent rotation of the nut 14 upon securing the screw. It would be considered that as shown in FIG. 14, a rear wall of the nut accommodating portion 12*f* of the housing body 12 is angled into conformity with the side surfaces of the nut 14, and the nut is held by sufficiently inserting the nut 14 through the opening 12*c*. In this case, the nut 14 is held by the housing body 12 only one pair of sides. Additionally, the housing body is made of resin material such as nylon, PBT, PET or the like, the nut supporting surface of the housing body may be deformed by the torque for securing the screw, with the result that the nut 14 is rotated. Therefore, it is difficult to secure the contact member 13 with large force. Therefore, the contact member 13 is not given a significant displacement.

In this embodiment, a projection 15*a* is provided in the inside of the cover housing 15 so as to hold at least one side of the nut 14 inserted in the nut accommodating portion 12*f*. More particularly, after the nut 14 and the contact member 13 are inserted into the housing body 12, the cover housing 15 is mounted to the backside of the housing body 12 and is sealed thereon with the nut supporting projection 15*a* being engaged with the nut accommodating portion 12*f* through the nut inserting opening 12*c*. Then, as shown in FIG. 13, the hexagonal nut 14 inserted into the nut accommodating portion (nut guide) 12*f* of the housing body 12 is supported at three pairs of sides by the end portion of the projection 15*a* being faced thereto.

Therefore, as compared with the case that only one pair of sides is supported as shown in FIG. 14, the force applied to the nut supporting portion of the housing body 12 is dispersed. This is effective to suppress the deformation of the nut supporting portion of the housing body 12, and therefore, the rotation of the nut 14 upon the securing of the screw 16 is prevented.

Figure 13:
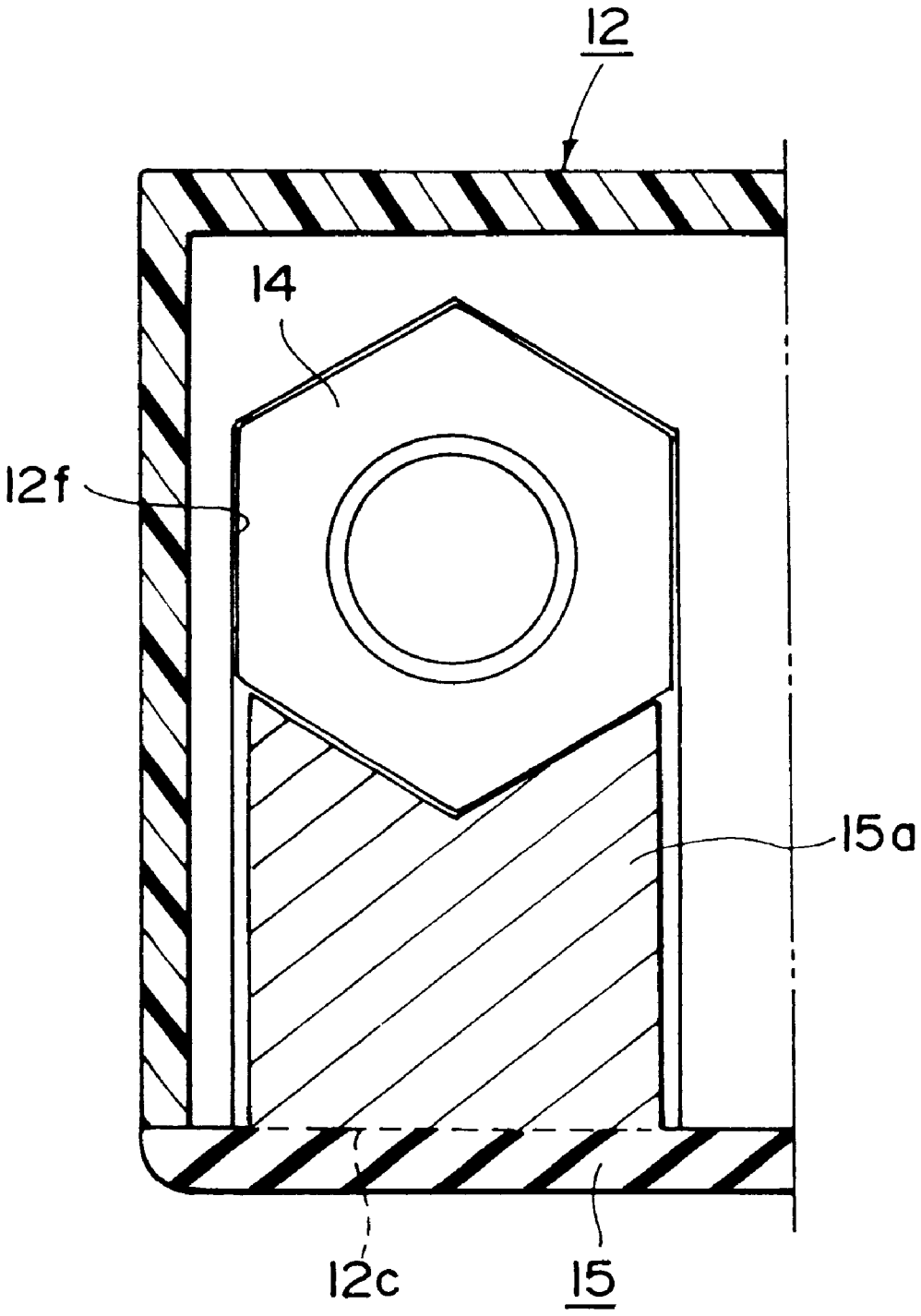
FIG. 13 shows a hexagonal nut.

As shown in FIGS. 8, 11 and 13, the hexagonal nut 14 is confined at the backside of the housing 12 by the projection 15*a* of the cover housing 14. Accordingly, the backward movement (broken line) due to the rotation of the nut 14 which occurs in the case of FIG. 14, is effectively prevented, so that the nut 14 is prevented from rotating upon the securing of the screw 16.

Since the cover housing 14 is provided with a projection 15*a* for supporting the nut, the force applied to the housing is dispersed, and the escape due to the nut rotation can be prevented. Therefore, after the heater base plate and the holder therefor are inserted into the contact member 13, the contact member 13 can be clamped stably by the screw 16. Thus, the load durable against creep under high temperature can be produced, thus enhancing the reliability of connection.

Figure 15:
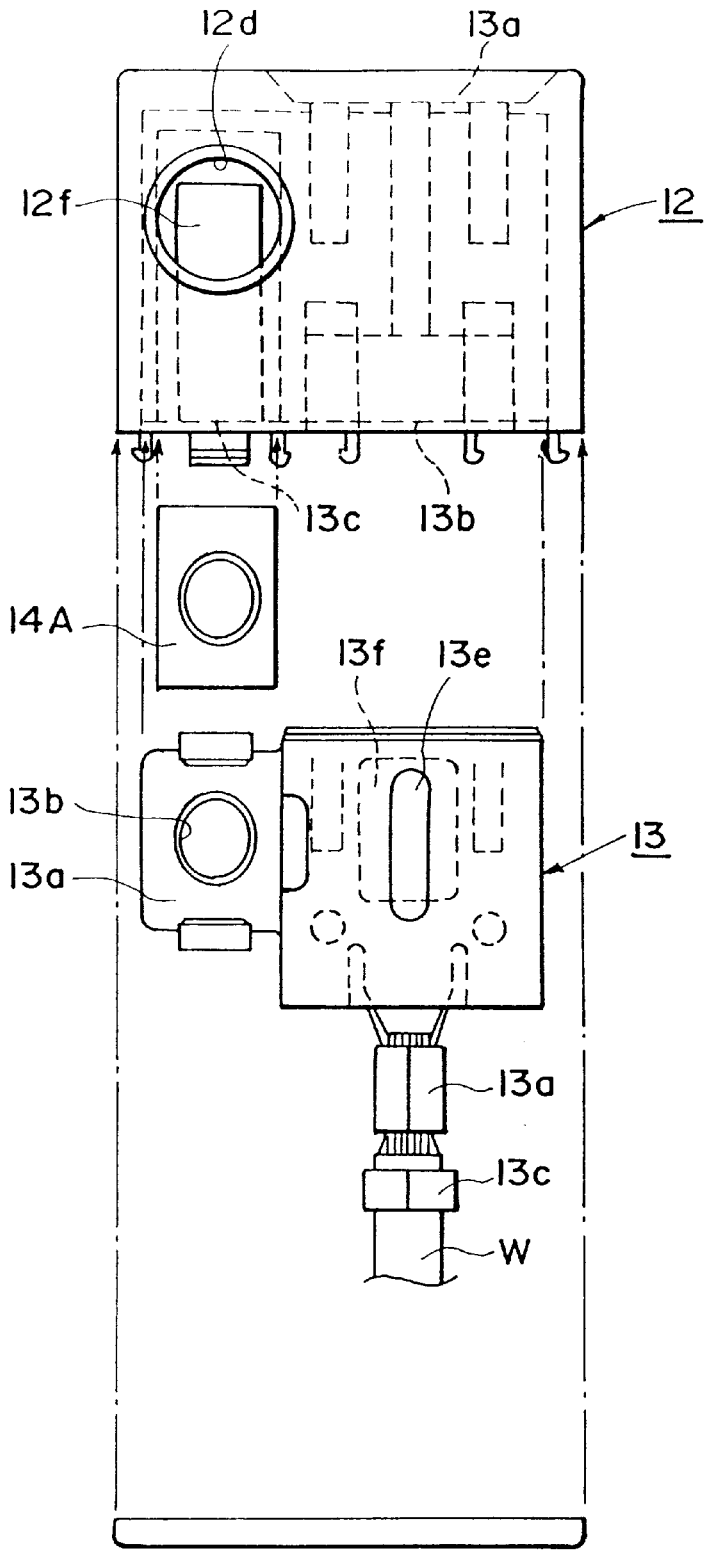
FIG. 15 is an exploded plan view of a connector using square nut.
Figure 16:
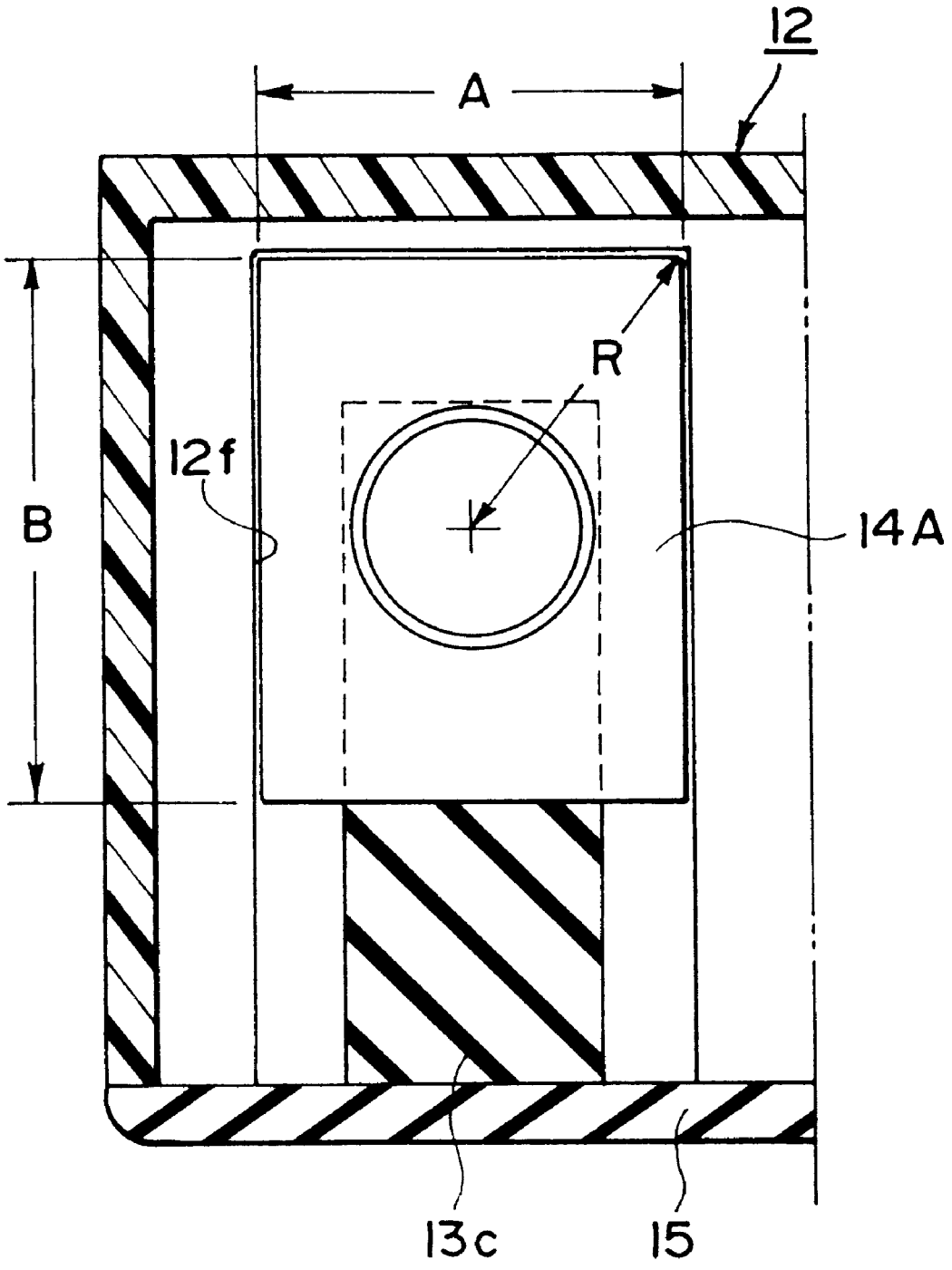
FIG. 16 illustrates an accommodated square nut.

In FIGS. 15 and 16, the nut to be inserted into the nut accommodating portion 12*f* of the housing body 12 is square. In this example, since the nut is square, the nut supporting area can be increased, and a distance R up to a torque acting point (nut end) applied to the housing body 12, can be increased as compared with the case of the hexagonal nut 14 (FIG. 14). This is effective to reduce the force applied to the acting point under the condition that the securing torque is the same. Therefore, the deformation of the housing body 12 is further suppressed.

Additionally, if the square nut 14*a* has rectangular, that is, the length of the sides A and B are different from each other. By doing so, the deformation of the housing body 12 required for the nut rotation can be increased. In other words, when A<B (FIG. 16), the rotation of the nut 14*a* is possible only when the two nut supporting surfaces of the housing body deform more than SQR $((A/2)^2+(B/2)^2)-(A/2)$ or more. If the deformation of the housing body 12 is smaller than this, the nut 14*a* is not rotated.

As in examples shown in FIGS. 15 and 16, the rectangular or square nut is effective to reduce the force applied to the housing body and therefore the deformation thereof, in other words, the deformation of the housing required for permitting the rotation is increased, the rotation of the nut can be effectively prevented. Accordingly, a large deformation can be imparted to the contact member 13 without rotation of the nut upon securing of the screw, and therefore, highly reliable connection can be accomplished under high temperature ambience.

Figure 17:
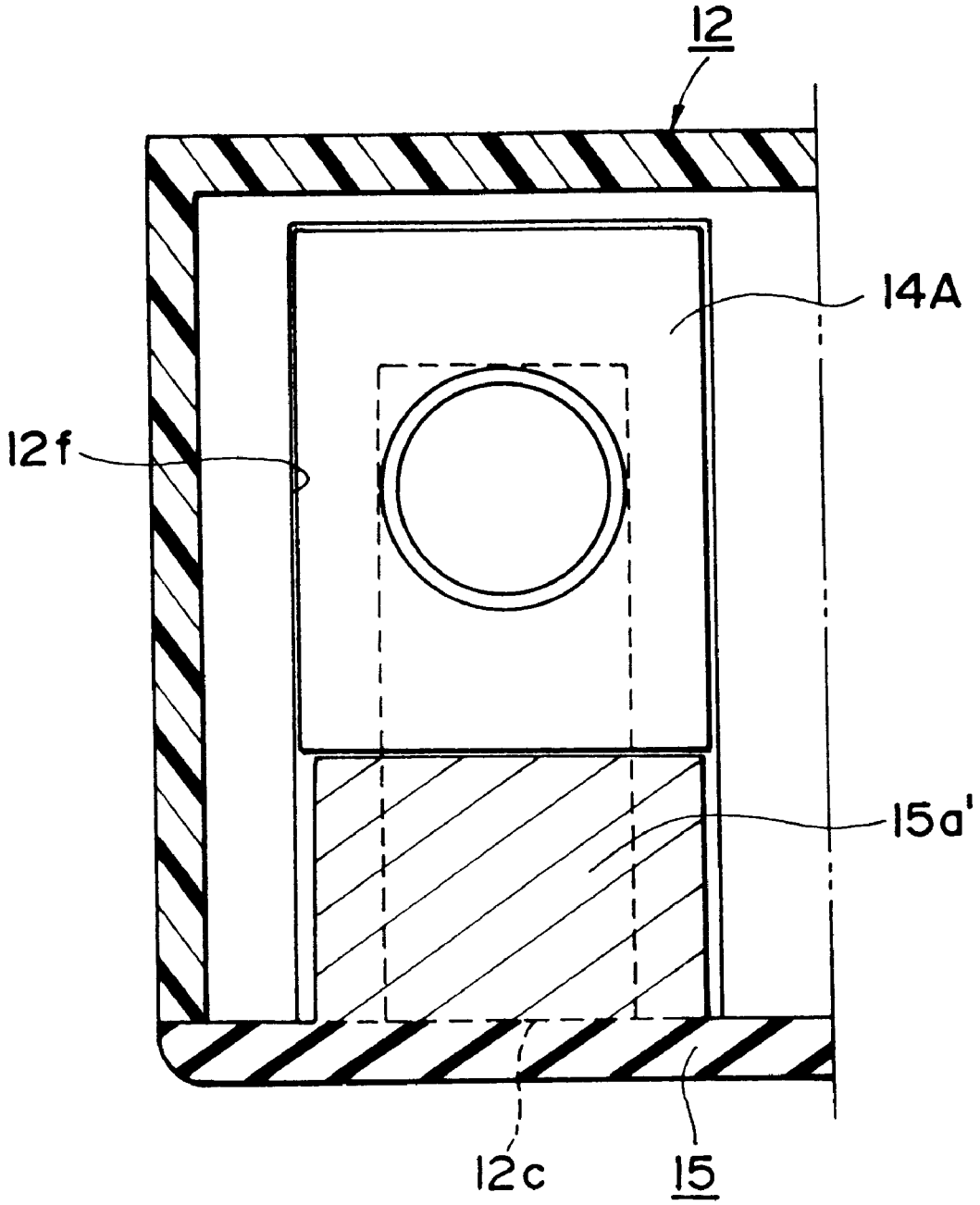
FIG. 17 illustrates supporting of the square nut.

Similarly to the case of hexagonal nut 14, the rotation prevention is enhanced and the backward movement of the nut 14*a* is prevented by providing a projection 15*a*' for supporting a side surface of the rectangular or square nut 14 in the cover housing 14, as shown in FIG. 17, also in the case of the square or rectangular nut.

Figure 18:
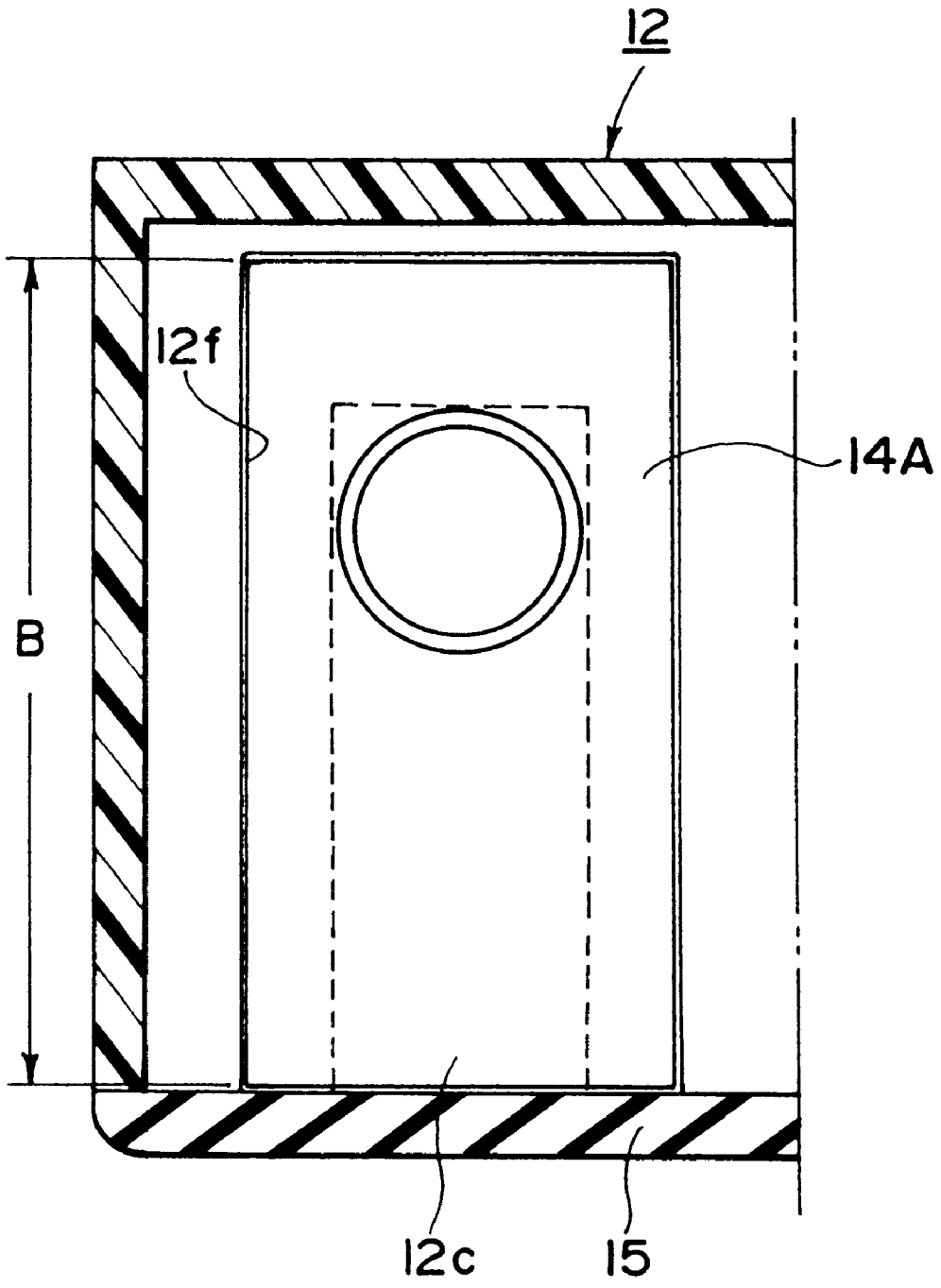
FIG. 18 shows another square nut supporting.

As shown in FIG. 18, the similar advantageous effects can be provided by making a length of the square or rectangular nut 14*a* in the inserting direction substantially the same as the length of the nut accommodating portion 12*f* in the nut inserting direction.

As described in the foregoing, the projection 15*a* for supporting a side of the nut is provided in the cover housing 14 for sealing the housing body 12, or a square or rectangular nut 14*a* is used, by which the contact member 13 can be clamped with large force by the screw 16 after the insertion, and therefore, a large deformation can be produced after the insertion into the contact member 13. Thus, high connection load can be provided, and the use under high temperature ambience is enabled. Additionally, the heater can be supplied with larger current, so that the fixing speed and fixable size are increased.

In this embodiment, a screw and nut 14 are used for clamping the contact member 13, but another means such as cam or wedge are usable.

The description will be made as to reduction of a bending stress in the inserting member. The load applied to the electrode contact 14 of the inserting member 1, 7 by the contact member 13 is provided by the inserting member 1, 7 does not displace (does not move against the load. In other words, the inserting member 1, 7 receives reaction of the load applied to the electrode contact 4 at the backside.

If the contact member 13 is a continuous member so that it is contacted to the backside of the inserting member, the contact member producing the load to the electrode contact 4 applies the reaction force of the same load to the inserting member to be balanced. Therefore, the connector 11 used under the high temperature ambience receives large reaction at the backside of the inserting member for the purpose of providing large load to the contact portion 13*e*. For example, as an extreme case, when the backside immediately below the connecting portion 13*e* is not contacted to the connector, the two forces applied on the inserting member 1, 7 (the load of the electrode contact 4 and the backside reaction), are not on the same line, but a certain deviation occurs. This results in production of moment and the bending stress in the inserting member 1, 7.

If the ceramic base plate is the inserting member, as compared with the case when the contact is established light below the connecting portion, the inserting member (ceramic base plate) is liable to be destroyed depending on the state of contact at the backside, because the bending strength of the ceramic base plate (92% of alumina) is 2500 $kgf/mm^2$, which is much smaller than the compression strength of 20,000 $kgf/mm^2$. For this reason, the reaction force applied to the inserting member is desirably taken into account.

Figure 20:
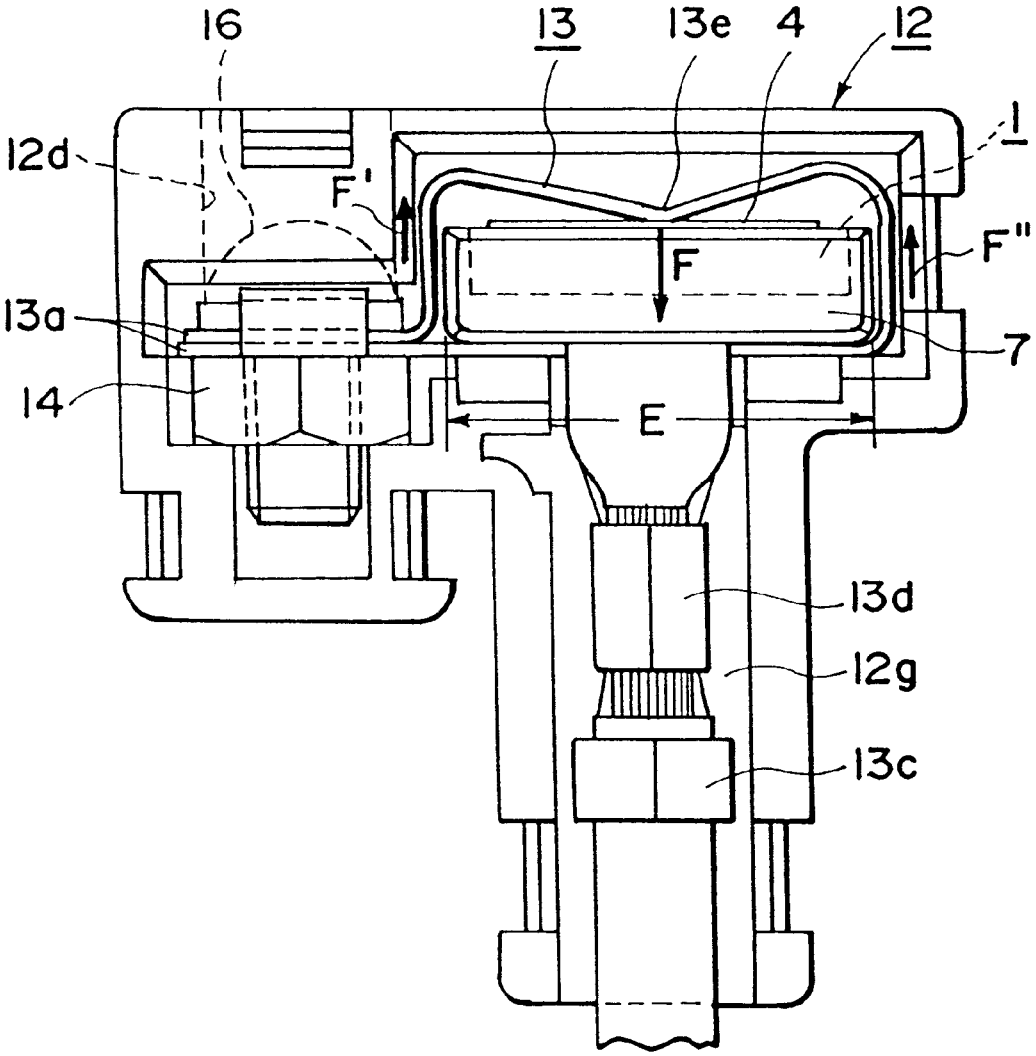
FIG. 20 illustrates bending stress in the heater and heater holder.

Even if the entire backside surface is in contact, the reaction force is F', F" resulting from the deformation of the V-shaped portion of the contact member 13 are applied to the backside of the inserting member by way of the side portion of the contact member, when the screw 16 is secured in the connector of FIG. 20. The acting portion is concentrated at the contact portion between the contact member 13 and the heater holder 7 closest from the side surface of the contact member 13. In other words, it applies in the upward direction to the edge of the heater holder 7 and tends to raise the backside of the heater holder 7.

Therefore, the force applied to the inserting member 1, 7 includes the downward force at the center and the upward force at the opposite end portions. The way of force application is so-called three point bending with the result of very high stress to the central electrode contact or the tab 13*a*, even to such an extent that the electrode contact, the ceramic substrate 2 or the tab 13 is broken.

When the inserting member 1, 7 is deformed by the bending stress, a lateral component is produced, with the possibility of the contacting portion 13*e* being slid with the result of instable contact, upon small external force applied thereto.

In this embodiment, as shown in FIG. 5, 7, 9, 10 and 12, the contact member 13 is provided with a projection 13*f* at a portion faced to the downward end portion (electric connection portion) 13*e* of V-shaped contactable to the electrode contact 4 of the inserting member 1, 7.

The configuration of the projection 13*f* is determined in consideration of the manufacturing tolerances of the contact member 13, and the deformation of the contact member 13 when the screw 16 is secured as shown in FIG. 12 (connecting state). More particularly, it is rectangular (width e in FIG. 10) expanding to provide a margin against the positional deviation at the opposite sides thereof so that the electric connecting portion 13*e* is at the center of the projection 13*f* the expansion is as small as possible to reduce the span of the bending stress, as will be described hereinafter.

As shown in FIGS. 10 and 12, when the inserting member 1, 7 is clamped on the contact member of the connector 11 by the screw 16, the electric connecting portion 13*e* is pressed and electrically connected relative to the electrode contact 4 of the heater with the load F provided by the deformation of the V-shape of the contact member. At this time, the contact member 13 produces the downward force at the end 13*e* of the V-shape, and simultaneously, upward forces F' and F" (−F=F'+F") at the opposite end portions of the V-shaped portion. Because of the balance of the forces, the connector and the inserting member do not move.

The upward forces F' and F" apply to the projection 13*f* contacted to the backside of the inserting member 1, 7 by way of the side portions of the contact member 13. In this case, the inserting member 1, 7 receives in the vertical direction within the very narrow width at the electrode surface and the backside. The bending stress is proportional to the span. In this embodiment, by the projection 13*f* from the holder width E which is the span in the conventional example, so that the span width reduces down to the width e of the projection 13*f*, and therefore, the stress can be significantly reduced.

The cross-section of the projection 13*f* may be arcuated or V-shaped to reduce the span if the machining accuracy of the contact member is high enough.

As described above, the contact member 13 has the projection 13*f* so that the contact member 13 and the inserting member 1, 7 are contacted right below the force applying portion to the electrode contact 4, so that the vertical force applied to the inserting member 1, 7 upon the connecting operation, become closer to a line, and therefore, excessive bending stress can be prevented. Thus, the stabilized connection can be established even if the high load is applied.

Figure 19:
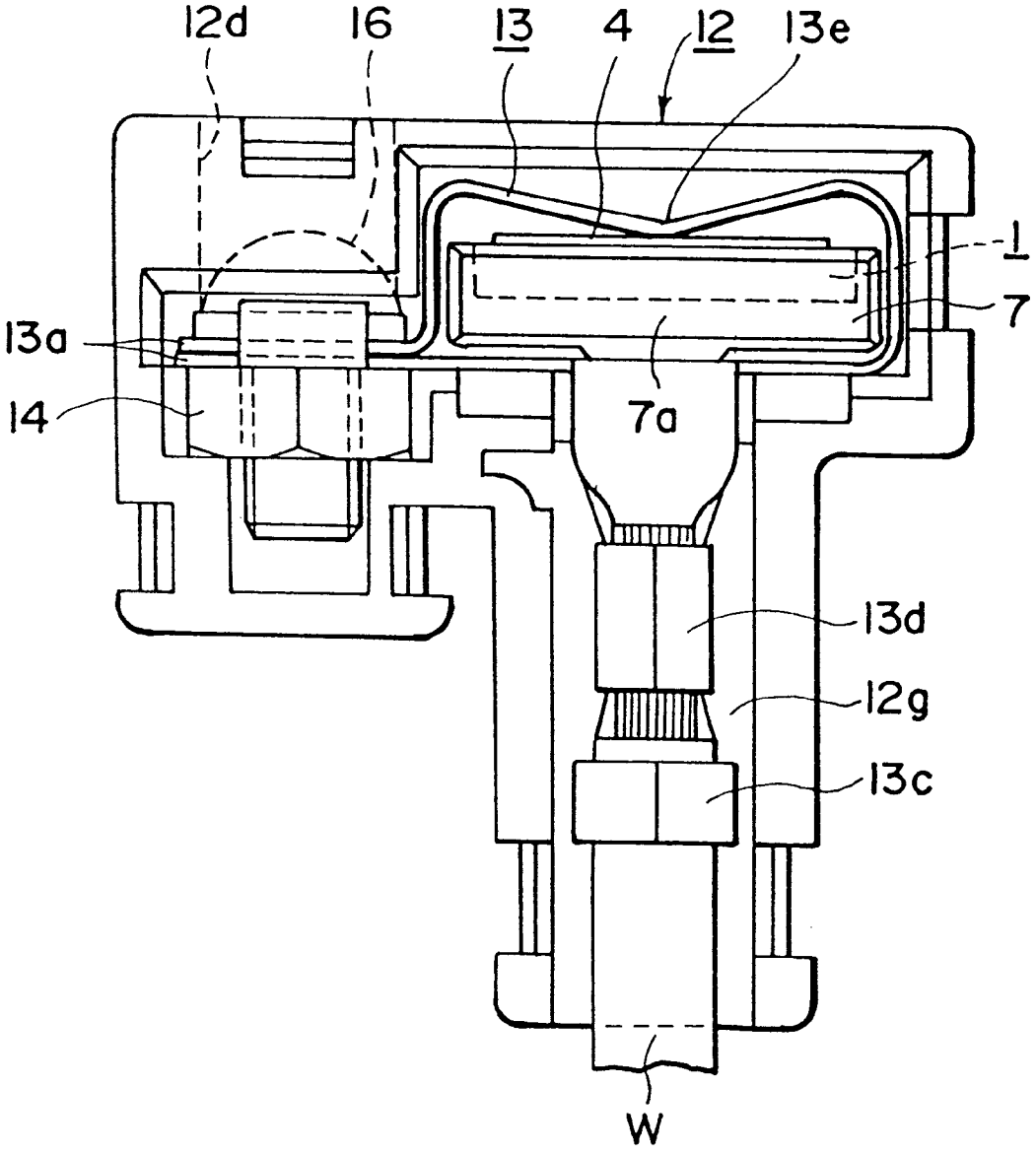
FIG. 19 illustrates contact between the contact member and the heater holder having a projection at the backside thereof.

As shown in FIG. 19, on the backside of the heater holder 7 (inserting member 1, 7), a projection 7*a* having the same function as the projection 13*f* of the contact member 13 may be provided. The projection 7*a* is provided right below the region where the electric contact portion 13*e* of the contact member 13 and the electrode contact 4 are connected.

The configuration of the projection 7*a* is rectangular in consideration of the deviation in the connecting portion due to the fitting tolerance upon the insertion of the inserting member 1, 7 and the contact member 13. In the state in which the inserting member 1, 7 is engaged with the contact member 13 of the connector 11, and the screw 16 is secured, the reaction forces F' and F" of the contact member are applied to the portion of contact between the contact member 13 and the projection 7 at the backside of the heater holder 2.

Similarly to FIGS. 10 and 12, wherein the contact member 13 is provided with the projection 13*f*, the excessive bending stress occurrence can be prevented so that the stable connection is possible.

The cross-section of the projection 7*a* may be arcuated or V-shaped. Additionally, projections 13*f* and 7*a* may be provided on the contact member 13 and the holder 7.

As described above, the contact portion between the contact member and the inserting member, to which the load is applied is only two portions, namely, the connecting portion where the force is in the direction of pressing the contact member to the electrode, and backside projecting portion on an extension of the force. Therefore, it is possible to avoid the bending stress. Additionally, the load applied portion is concentrated on the connecting portion, and therefore, the stabilized connection is accomplished a projection is provided on the backside of the inserting member or the contact member for receiving the backside of the inserting member such that the center thereof is aligned with the line of the force applied to the electrode, so that the connection between the backside of the inserting member and the contact member is established by the projection, by which the bending stress applied to the inserting member upon the connecting operation can be reduced. Thus, high connecting load can be applied to avoid the improper connection attributable to the creep under the high temperature condition. Additionally, a large current can be used so that the electric energy can be property supplied to a large power heater, thus permitting high speed fixing and the fixing of large size sheet.

While the invention has been described with reference to the structures disclosed herein, it is not confined to the details set forth and this application is intended to cover such modifications or changes as may come within the purposes of the improvements or the scope of the following claims.

What is claimed is:

1. An image heating apparatus comprising:

an elongated heater including a base plate, a heat generating portion and an electrode;

a film in sliding contact with said heater, wherein a toner image on a recording material is heated by heat from said heater through said film;

a connector for supplying electric energy to said heater, said connector including an electroconductive contact member having a projection at such a position that said projection is contactable to said electrode;

clamping means for clamping said contact member to said heater; and a connector opening for mounting said connector to and demounting said connector from said heater in a longitudinal direction of said heater, wherein when said connector is mounted to said heater through said opening, said projection is spaced away from said electrode, and after said connector is mounted, said projection is contacted to said electrode by said clamping means.

2. An apparatus according to claim 1, wherein said clamping means includes a screw.

3. An apparatus according to claim 2, wherein said connector is provided with an engaging portion for prohibiting movement of said nut.

4. An apparatus according to claim 1, wherein said projection has a V-shaped cross-section.

5. An apparatus according to claim 1, wherein said contact member is provided with a projection at a position corresponding to an opposite side of said electrode.

6. An apparatus according to claim 1, wherein said contact member is an elastic member.

7. An apparatus according to claim 1, wherein said connector comprises an electrically insulative housing for accommodating said contact member.

8. An apparatus according to claim 1, wherein said heater extends in a direction substantially perpendicular to a movement direction of the film, and said connector is connected to a longitudinal end of said heater.

9. An apparatus according to claim 8, wherein said connector is connected to each longitudinal end of said heater.

10. An apparatus according to claim 1, further comprising a heater holder for holding said heater, and said contact member encloses said heater and said heater holder.

11. An apparatus according to claim 1, wherein said electrode is provided adjacent an end portion of said heat generating portion.

12. An apparatus according to claim 1, wherein said contact member covers an entire circumferential periphery of an end portion of said heater.

* * * * *

UNITED STATES PATENT AND TRADEMARK OFFICE

CERTIFICATE OF CORRECTION

PATENT NO. : 6,023,047

DATED : February 8, 2000

INVENTOR(S): HIROSHI KONDO, ET AL.

It is certified that error appears in the above-identified patent and that said Letters Patent is hereby corrected as shown below:

SHEET NO. 4:
Figure 4, sheet 4, should be deleted.

COLUMN 1:
Line 11, "machine" should read --machine,--; and
Line 13, "connector" should read --connectors--.

COLUMN 2:
Line 4, "having" should read --a--.

Figure 5A:
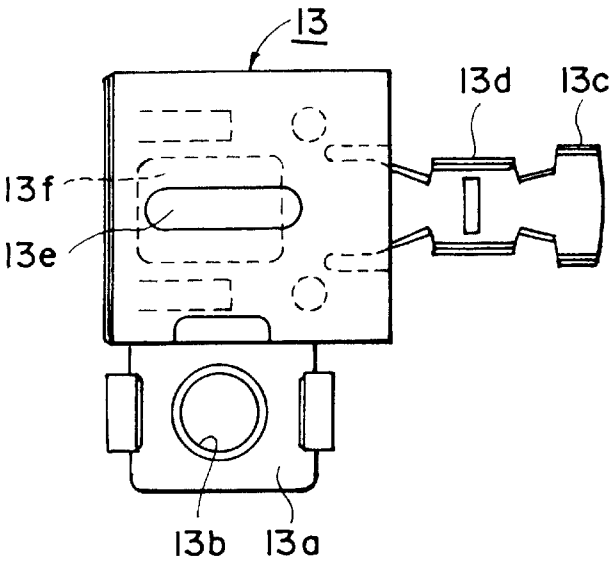
FIG. 5 illustrates a contact member of the connector.
Figure 5C:
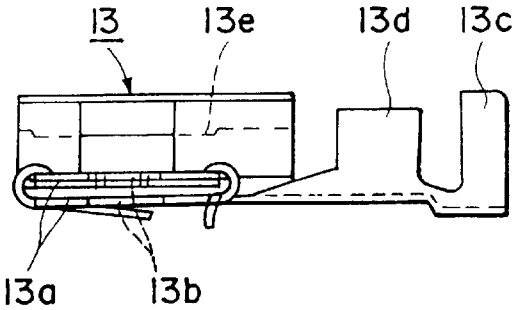
Figure 5B:
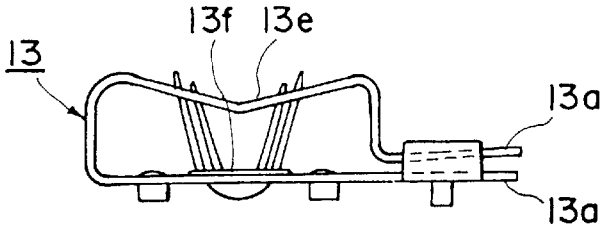
Figure 6D:
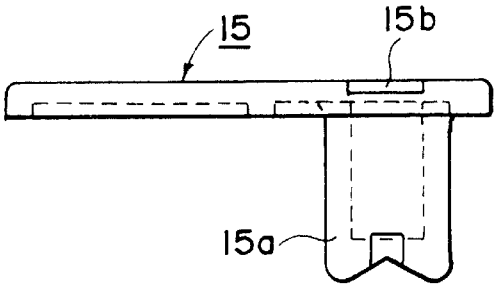
FIG. 6 illustrates a housing cover of the connector.
Figure 6C:
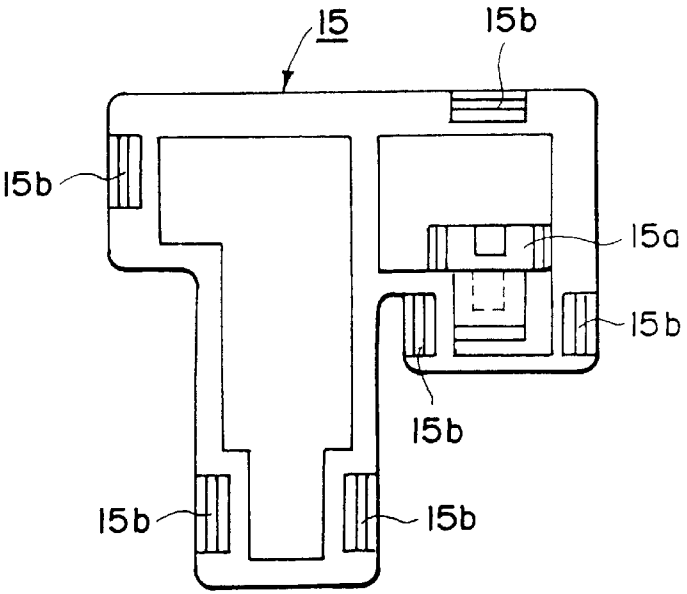
Figure 6B:
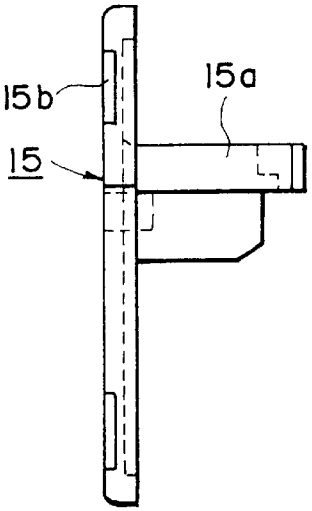
Figure 6A:
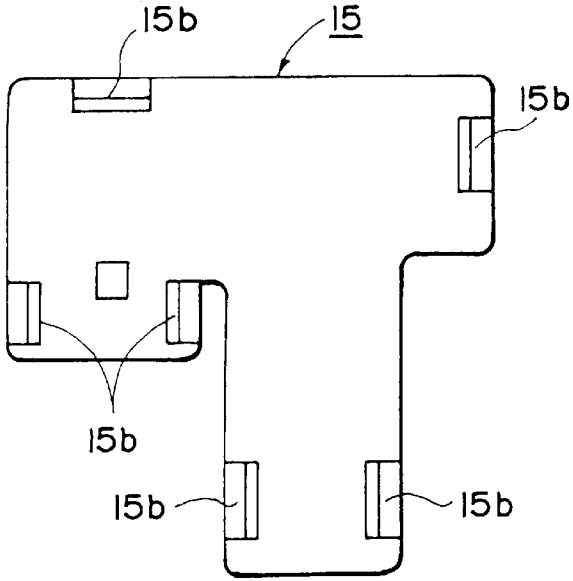

COLUMN 3:
Line 2, "FIG. 4 illustrates" should read --FIGS. 4(a)-4(d) illustrate--;
Lien 3, "FIG. 5 illustrates" should read --FIGS. 5(a)-5(c) illustrate--; and
Line 4, "FIG. 6 illustrates" should read --FIGS. 6(a)-6(d) illustrate--.

COLUMN 4:
Line 23, "4,4" should be deleted.

UNITED STATES PATENT AND TRADEMARK OFFICE

CERTIFICATE OF CORRECTION

PATENT NO. : 6,023,047

DATED : February 8, 2000

INVENTOR(S): HIROSHI KONDO, ET AL.

It is certified that error appears in the above-identified patent and that said Letters Patent is hereby corrected as shown below:

COLUMN 5:

Line 17, "lest" should read --left--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*